US009458680B2

(12) United States Patent
Kannegaard et al.

(10) Patent No.: US 9,458,680 B2
(45) Date of Patent: Oct. 4, 2016

(54) DRILLING RIG

(71) Applicants: Michael Kannegaard, Espergaerde (DK); Allan McColl, Glasgow (GB)

(72) Inventors: Michael Kannegaard, Espergaerde (DK); Allan McColl, Glasgow (GB)

(73) Assignee: MAERSK DRILLING A/S, Copenhagen (DK)

( * ) Notice: Subject to any disclaimer, the term of this patent is extended or adjusted under 35 U.S.C. 154(b) by 626 days.

(21) Appl. No.: 13/772,709

(22) Filed: Feb. 21, 2013

(65) Prior Publication Data

US 2014/0196948 A1 Jul. 17, 2014

(30) Foreign Application Priority Data

Jan. 11, 2013 (DK) ..... 2013 70017

(51) Int. Cl.

| | |
|---|---|
| ***E21B 15/02*** | (2006.01) |
| ***E21B 19/00*** | (2006.01) |
| ***E21B 19/14*** | (2006.01) |
| ***E21B 19/15*** | (2006.01) |

(52) U.S. Cl.

CPC ..... *E21B 19/002* (2013.01); *E21B 15/02* (2013.01); *E21B 19/143* (2013.01); *E21B 19/155* (2013.01)

(58) Field of Classification Search

CPC ..... E21B 15/02; E21B 15/003; E21B 43/01; E21B 19/002; E21B 19/143; E21B 19/155

USPC ..... 175/5

See application file for complete search history.

(56) References Cited

U.S. PATENT DOCUMENTS

| | | | | |
|---|---|---|---|---|
| 1,867,030 | A * | 7/1932 | Roberts | 166/358 |
| 2,999,549 | A * | 9/1961 | Stratton | 175/5 |
| D197,868 | S * | 3/1964 | Thornton et al. | D12/310 |
| 3,949,818 | A | 4/1976 | Russell | |
| 4,129,221 | A | 12/1978 | Moller | |
| 4,208,158 | A * | 6/1980 | Davies et al. | 414/22.68 |
| 4,618,286 | A | 10/1986 | Michel et al. | |
| 6,047,781 | A * | 4/2000 | Scott et al. | 175/5 |

(Continued)

FOREIGN PATENT DOCUMENTS

| | | |
|---|---|---|
| GB | 2071734 A | 9/1981 |
| WO | 97/23705 A1 | 7/1997 |

(Continued)

OTHER PUBLICATIONS

Maersk, Maersk Drilling Ultra deepwater semi-submersible rig—Maersk Developer, Dec. 22, 2011, Received from the internet: URL:https//www.youtube.com/watch?v=oguoULvWVzo.

(Continued)

*Primary Examiner* — James G Sayre

(74) *Attorney, Agent, or Firm* — Buchanan Ingersoll & Rooney PC

(57) ABSTRACT

Disclosed herein are embodiments of an offshore drilling rig comprising a drill floor deck having a hole defining a first well center. Embodiments of the drilling rig further comprise a first mast upwardly extending relative to the drill floor deck, and a first hoisting system supported by the first mast and configured for hoisting and lowering tubular equipment through the first well center. The first mast is located on a first side of the first well center. Embodiments of the drilling rig further comprise first pipe handling equipment for presenting tubular equipment to the first hoisting system so as to allow the first hoisting system to hoist or lower the tubular equipment through the first well center.

40 Claims, 11 Drawing Sheets

(56) References Cited

U.S. PATENT DOCUMENTS

| | | | | |
|---|---|---|---|---|
| 6,094,910 | A | 8/2000 | Vatne | |
| 6,217,258 | B1 * | 4/2001 | Yamamoto et al. | 405/201 |
| 6,361,262 | B1 | 3/2002 | Roodenburg | |
| 6,766,860 | B2 * | 7/2004 | Archibald et al. | 166/341 |
| 6,901,998 | B1 | 6/2005 | Roodenburg et al. | |
| 7,377,335 | B2 * | 5/2008 | Jones et al. | 175/57 |
| 7,628,225 | B2 | 12/2009 | Petersson et al. | |
| 7,802,636 | B2 | 9/2010 | Childers et al. | |
| 9,045,948 | B2 * | 6/2015 | Roodenburg et al. | |
| 2003/0159853 | A1 | 8/2003 | Archibald et al. | |
| 2005/0126790 | A1 * | 6/2005 | Beato et al. | 166/358 |
| 2005/0126792 | A1 | 6/2005 | Berry | |
| 2008/0047755 | A1 * | 2/2008 | Trevisani | 175/85 |
| 2008/0251258 | A1 | 10/2008 | Bamford et al. | |
| 2009/0151955 | A1 * | 6/2009 | Bamford et al. | E21B 3/045 166/335 |
| 2009/0223660 | A1 | 9/2009 | Petersson | |
| 2010/0230115 | A1 | 9/2010 | Belik | |
| 2011/0017511 | A1 | 1/2011 | Payne | |
| 2011/0048310 | A1 * | 3/2011 | Roodenburg et al. | 114/268 |
| 2011/0103922 | A1 | 5/2011 | Belik | |
| 2012/0217006 | A1 | 8/2012 | Springett et al. | |
| 2012/0305261 | A1 * | 12/2012 | Roodenburg et al. | 166/352 |

FOREIGN PATENT DOCUMENTS

| | | | |
|---|---|---|---|
| WO | 97/28347 | A1 | 8/1997 |
| WO | 99/11901 | A1 | 3/1999 |
| WO | 99/31346 | A1 | 6/1999 |
| WO | 02/18742 | A1 | 3/2002 |
| WO | 2007/093787 | A1 | 8/2007 |
| WO | 2008/103156 | A2 | 8/2008 |
| WO | 2008/121071 | A1 | 10/2008 |

OTHER PUBLICATIONS

Notification of Transmittal of the International Search Report (Form PCT/ISA/220 and Form PCT/ISA/210) and the Written Opinion of the International Searching Authority (Form PCT/ISA/237), or the Declaration issued on Sep. 19, 2014, by the European Patent Office in corresponding International Application No. PCT/EP2014/050509. (14 pages).

Notification of Transmittal of the International Search Report (Form PCT/ISA/220 and Form PCT/ISA/210) and the Written Opinion of the International Searching Authority (Form PCT/ISA/237), or the Declaration issued on Sep. 19, 2014, by the European Patent Office in corresponding International Application No. PCT/EP2014/050510. (15 pages).

Danish Office Action dated Apr. 24, 2013, issued in corresponding PA Application No. 2013 70017. (5 pgs).

NOV National Oilwell Varco,Pipe Handling Solutions, http://www.nov.com, 2012 National Oilwell Varco.

P.A. Vatne., et al., The Ramrig Concept for Drilling and Workover Rigs, IADC/SPE Drilling Conference, Mar. Dec. 15, 1996, pp. 117-124, New Orleans, Louisiana.

Island_Innovator http://www.ciaas.no/oldweb/images/ISLAND_INNOVATOR.JPG; retrieved from the Internet on Jun. 7, 2013—but possibly available at an earlier date.

Jack Up Drill Floor and Pipe Handling, http://www.ciaas.no/oldweb/images/03-01-EXPLORER.JPG; 2013.

Jack Up Drill Floor, http://www.ciaas.no/oldweb/images/RP.jpg; retrieved from the Internet on Jun. 7, 2013—but possibly available at an earlier date.

Nvi-paa-Bideford-Dolphin_large, http://www.ptil.no/news/consent-to-use-bideford-dolphin-for-drilling-and-well-activities-in-the-north-sea-art; May 30, 2011.

Products_Heavecompensator, http://www.iconeng.com.au/products_equipmentssdr.html; 2013.

Stena_Forth, http://www.ciaas.no/oldweb/images/STENA_FORTH.jpg; retrieved from the Internet on Jun. 7, 2013—but possibly available at an earlier date.

West Eminence sailaway Korea1, http://www.akersolutions.com/en/Global-menu/Products-and-Services/technology-segment/Drilling-technologies/Drilling-lifecycle-services/Global-DLS-newsletter/Global-DLS-newsletter-issue-two/Attentive-ambassadors-/; retrieved from the Internet on Jun. 7, 2013—but possibly available at an earlier date.

Cylinder Hoisting Rigs NOV homepage2; Nov. 10, 2012.

Cylinder Hoisting Rigs NOV homepagel; Nov. 10, 2012.

Cylinder hoisting rig. Product description (online). National oilwell varco, Oct. 17, 2012(retrieved on Apr. 15, 2013). Retrieved from the internet<url:http://www.nov.com/Drilling/Hoisting/Cylinder_Hoisting_Rigs.aspx>.

Hoisting Systems—Aker Solutions. Drilling Technologies; retrieved from the Internet on Jun. 7, 2013—but possibly available at an earlier date.

* cited by examiner

DRILLING RIG

TECHNICAL FIELD

The invention generally relates to offshore drilling rigs, often also referred to as offshore drilling platforms. More particularly, the invention relates to a semi-submersible drilling rig.

BACKGROUND

Offshore drilling rigs are widely used in the exploration and exploitation of hydrocarbon reservoirs under the sea floor.

One type of drilling structure is the semi-submersible drilling rig that typically obtains its buoyancy from ballasted, watertight pontoons located below the ocean surface and wave action. The operating deck can be located high above the sea level due to the high stability of the design, and therefore the operating deck is kept well away from the waves. Structural columns connect the pontoons and operating deck.

U.S. Pat. No. 6,766,860 discloses an offshore drilling rig of the semi-submersible type comprising two load paths within the same derrick. The derrick floor is elevated above the rest of the drilling deck. Rotary tables are positioned in the drill deck below the primary and secondary hoisting paths. On the drill deck, drill pipe and the drill bit is made up and run through the water column to the sea bed where it is rotated by either the rotary table and/or a rotating mechanism (top drive) suspended in the derrick. Later, casing tubulars are assembled in one of the hoisting paths and run into the hole. Ramps feed pipes to the primary and secondary hoisting paths respectively.

It is generally desirable to provide an offshore drilling rig that allows for a more efficient and flexible operation. It is further generally desirable to provide an offshore drilling rig that facilitates operation with a high degree of safety.

SUMMARY

Disclosed herein are embodiments of an offshore drilling rig comprising a drill floor deck having a hole defining a first well centre. Embodiments of the drilling rig further comprise a first mast upwardly extending relative to the drill floor deck, and a first hoisting system supported by the first mast and configured for hoisting and lowering tubular equipment through the first well centre. The first mast is displaced from and located on a first side of the first well centre. Embodiments of the drilling rig further comprise first pipe handling equipment for presenting tubular equipment to the first hoisting system so as to allow the first hoisting system to hoist or lower the tubular equipment through the first well centre.

Consequently, when the first mast is displaced from the first well centre, access to the well centre is facilitated not only for human operators but also for equipment, including tubular equipment and other large equipment that does not have to be maneuvered through openings of the mast structure in order to have access to the well centre. In particular, access to the well centre is facilitated from at least three sides other than the first side. This is in contrast to conventional derrick structures that surround the well centre, i.e. where the well centre lies within the foot print of the derrick, normally at or in close proximity to the geometrical centre of the footprint. In such systems, all lateral access has to pass through lateral openings of the derrick structures, which are often formed as an inverted V in the sides of the structure and which are referred to as V-doors. Nevertheless, despite the presence of such openings, access is restricted by the mast structure, in particular by the width and height of any such openings.

For the purpose of the present description, the term "mast" refers to a support structure upwardly extending relative to the drill floor deck and supporting a hoisting system for hoisting and lowering tubulars (such as drill strings, casings and/or risers) towards the seabed so that drilling into the seabed can be performed. The mast may extend from the drill floor deck or from a deck different from the drill floor deck. In any event, the mast including the load bearing structure of the hoisting system define a footprint on the drill floor deck or at least within a plane defined by the drill floor deck. The footprint may be defined as the space in the plane defined by the drill floor deck that is occupied or enclosed by the mast structure and the load bearing structure of the hoisting system, i.e. as a cross-section of the mast and the load bearing structure of the hoisting system in the plane of the drill floor deck. The position of the mast may be defined by a geometrical centre of the footprint. The hoisting system may be a hydraulic hoisting system comprising upwardly extending cylinders for carrying the load to be hoisted or lowered typically via large sheaves mounted on top of the cylinders. The load bearing structure of a cylinder rig thus comprises the cylinders and the sheaves. The footprint of such cylinders in the plane of the drill floor deck is also part of the mast footprint. The cylinders may extend from the drill floor deck or from a foundation below or elevated above the drill floor deck. The loads exerted on the hoisting system during lowering or hoisting of equipment in or out of the well centre can be said to be at least partially transferred to the drilling vessel via cylinders. Hence, in such embodiments, the mast predominantly supports the hoisting systems in the horizontal direction while the load is carried by the cylinders. In some embodiments, the hoisting system may be a draw works system. For such systems the sheaves are typically carried by the mast instead and loads are instead transferred to the drilling vessel via the mast, i.e. the mast supports the hoisting system vertically and horizontally. In a draw works system, the load bearing structure comprises the sheaves and those mast portions that carry the sheaves and any load suspended from the sheaves. The draw works motor may be completely or partially encapsulated by the mast structure.

In some embodiments, a longitudinal direction may be defined in the plane of the drill floor deck as a direction extending through the first well centre and through the position of the first hoisting system. The position of the first hoisting system within the plane of the drill floor deck may be defined as a position of a centre of mass of the top sheave of the first hoisting system over which the hoist lines of the first hoisting system are run. In a cylinder hoisting system the top sheave is a traveling sheave supported and pushed upwards by the cylinders. In draw works and mast system the top is typically fixed to the mast. In a draw works and derrick system the top sheave is a typically a fixed sheave in the crown block. Similarly, a transverse direction may be defined within the plane of the drill floor deck as extending normal to the longitudinal direction.

In some embodiments, the first mast defines a footprint on the drill floor deck, where the drill floor deck extends outside the footprint. The drill floor deck area extending outside the footprint of the first mast may be sized and shaped so as to allow installation of skid beams for skidding equipment and/or for a forklift or other vehicles to operate on the drill floor deck area outside the mast footprint. In some embodiments, skid beams are installed on the drill floor deck. For example, the drill floor deck area outside the mast footprint may be at least 200 $m^2$, such as at least 500 $m^2$, such as at least 1000 $m^2$, such as at least 2000 $m^2$, e.g. at least 5000 $m^2$. In particular, the first well centre may be located outside the footprint defined by the first mast, and the first well centre may be displaced from the footprint along the longitudinal direction. In some embodiments, the drill floor deck comprises one or more open drill floor deck areas not otherwise obstructed by fixed installations such as the first mast, further masts, pipe handling equipment, and/or the like, as will be described in more detail below.

In some embodiments, the drill floor deck and, in particular, the part in direct proximity to the well centre is stationary without the need to hoist or lower parts of the drill floor deck to allow running (i.e. lowering) the blow-out preventer (BOP) and/or other heavy well-control equipment (e.g. the Christmas tree). In some embodiments, the BOP and/or other heavy well-control equipment is stored on a deck below the drill floor deck. Consequently, such well-control equipment does not take up space on the drill floor deck.

The term well centre refers to a hole in the drill floor deck through which the drilling rig is configured to lower tubulars towards the seabed and, in particular, through which tubulars may be lowered all the way to the seabed. A well centre is sometimes also referred to as a drilling centre. It will be appreciated that the drill floor deck may comprise additional holes such as foxholes and mouseholes that may e.g. be used for building stands of tubulars but through which the drilling rig cannot lower tubulars to the seabed and/or through which the drilling rig cannot perform drilling into the seabed e.g. by lacking a system arranged to rotate a drill string with sufficient force such as a top-drive or a turntable. In some embodiments, such an additional hole is a hole in the drill floor deck through which the drilling rig cannot progress a drill string through a riser system. In some embodiments, a well centre is differentiated from an additional hole by having a diverter and/or a diverter housing arranged below so that drill string passed through the well centre extends through said diverter or diverter housing.

The offshore drilling rig may be a semi-submersible drilling rig, i.e. it may comprise one or more buoyancy pontoons located below the ocean surface and wave action, and an operation platform elevated above the ocean surface and supported by one or more column structures extending from the buoyancy pontoon to the operation platform. Alternatively, the offshore rig may be of a different type, such as a jack-up drilling rig or a drill ship.

In some embodiments, the first pipe handling equipment defines a first pipe feeding path along which tubular equipment is moved towards the first well centre. In particular, the first pipe feeding path may intersect the first well centre; the first pipe handling equipment may be configured to move tubular equipment towards the well centre from a second side of the well centre, opposite the first side on which the mast is located. The first pipe feeding path may be a straight path or it may have a different shape, e.g. comprise multiple path sections, one, some or all of which may be straight. When the first pipe feeding path extends substantially along the longitudinal direction (at least proximal to the well centre such as e.g. within 1 m or more, such as within 2 m or more, such as within 3 m or more, such as within 4 m or more, such as within 5 m or more, such as within 10 m or more) lateral drill floor deck areas extending transversely adjacent the well centre may be kept free of pipe handling equipment, such as pipe rackers, iron roughnecks etc. and, in particular, free of horizontal pipe handling equipment such as tubular feeding machines, e.g. catwalk machines. Also, for embodiments where the drilling vessel comprises further well centre(s) arranged along the transverse direction arranging the pipe handling equipment on the second side may allow pipe handling equipment to service more than one well centre and/or pipe handling equipment servicing the first well centre may cooperate with the pipe racking equipment servicing a second well centre. Similarly, when the first pipe feeding path extends substantially along the transverse direction, lateral drill floor deck areas extending longitudinally adjacent the well centre may be kept free of pipe handling equipment. In the latter case tubulars are typically moved from a storage area located at the first side and/or transversely located relative to the well centre. Here, the term substantially along the longitudinal direction or transverse direction is intended to refer to a direction parallel to said direction and directions slightly deviating from said direction such as within +/−30°, e.g. +/−20°, +/−10°, such as +/−5°.

The term tubular equipment is intended to refer to tubular equipment that is advanced through the well centre towards the sea floor during one or more stages of the drilling operation. In particular, the term tubular equipment refers to straight tubular elements that can be joined to form a string of tubular equipment. The tubular equipment may be selected from drill pipes and/or other tubular elements of the drill string, risers, liners and casings. Examples of tubular elements of the drill string include drill pipes, drill collars, etc. For the purpose of the present descriptions these will also generally be referred to as tubulars.

In some embodiments, the first pipe handling equipment comprises first horizontal pipe handling equipment for handling horizontally oriented tubular equipment, and first vertical pipe handling equipment for handling at least vertically oriented tubular equipment. Consequently, the first pipe handling equipment allows tubulars from different storage/setback areas for storing tubulars at different orientations to be moved to the well centre and/or between one or more storage areas using a common pipe feeding path, thus allowing other drill floor deck areas to be kept free of pipe handling equipment. The first horizontal pipe handling equipment may be configured to move tubular equipment along a first pipe feeding path towards the first well centre, e.g. along a first straight pipe feeding path. For example, tubulars may be moved from a horizontal storage area by means of the horizontal pipe handling equipment and raised into a vertical orientation by means of the vertical pipe handling equipment, the hydraulic hoisting system, the horizontal pipe handling equipment, and/or by two or more of such devices cooperating with one another. Similarly, tubulars from a vertical storage position may be moved to the well centre by the vertical pipe handling equipment.

The horizontal pipe handling equipment may be any suitable apparatus or device for moving tubulars in a horizontal orientation and/or for raising—alone or in cooperation with other pipe handling equipment—tubular equipment from a horizontal to a vertical orientation. Examples of horizontal pipe handling equipment include catwalk machines, such as catwalk shuttles. The vertical pipe handling equipment may be any suitable apparatus or device for moving tubulars in a vertical orientation and/or for changing—alone or in cooperation with other pipe handling equipment—the orientation of tubular equipment, e.g. between a horizontal and a vertical orientation. Examples of vertical pipe handling equipment include column rackers, hydrarackers, and other types of rackers, hydraulic arms, etc. or combinations thereof.

In some embodiments, the first vertical pipe handling equipment is movable between at least a first position on the first pipe feeding path between the first horizontal pipe handling equipment and the first well centre and a second position laterally displaced relative to the first pipe feeding path. Hence, the first vertical and horizontal pipe handling equipment may cooperate with each other and/or with the hoisting system of the first mast to perform a variety of pipe handling operations. In particular the pipe handling operations do not occupy unnecessary drill floor deck area and do not affect operations that are simultaneously performed at other drill floor deck areas, thus leaving one or more drill floor deck areas free of pipe operations such as an open drill floor deck area as discussed below. In particular, when the vertical pipe handling equipment is at the first position it may be configured to receive tubular equipment from the first horizontal pipe handling equipment. Moving the vertical pipe handling equipment to the second position, on the other hand, allows tubular equipment to be moved by the horizontal pipe handling equipment directly to the first well centre. To this end, the horizontal pipe handling equipment may be movable, e.g. on rails or skid beams or another suitable guide, along the first pipe feeding path to and away from the first well centre.

The horizontal pipe handling equipment may be located on the drill floor deck, i.e. on the same level as the drill floor deck. Furthermore, the horizontal pipe handling equipment may be surrounded by drill floor deck areas shaped and sized to allow human operators and/or movable equipment such as forklifts and/or skiddable equipment to move alongside (i.e. parallel to the long side of the pipe when handled by the horizontal pipe handling equipment) and/or around the horizontal pipe handling equipment and/or between the horizontal pipe handling equipment and other parts of the drill floor deck including the well centre. Due to the absence of height differences such movement is further possible in a safe and efficient manner.

For the purpose of this description, the term drill floor deck is intended to refer to the deck of an operating platform of an offshore drilling rig immediately above which joints of tubulars are assembled to form the drill string which is advanced through the well centre towards the seabed. The part of the drill floor deck in immediate proximity of the well centre is normally referred to as the drill floor, which is the primary work location for the rig crew and/or machines performing similar functions, such as iron roughnecks. The drill floor normally comprises a rotary table for rotating the drill string. For the purpose of the present description, the term drill floor deck includes the drill floor located directly under/next to the mast and surrounding the well centre as well as deck areas on the same level as and connected with the drill floor by uninterrupted floor area on the same level, i.e. the deck area where human operators and movable equipment such as forklifts, equipment moved on skid-beams, etc. can move around and to/from the well centre; in some embodiments without having to climb/descend stairs or other elevations. The drill floor deck is typically the floor of a platform, e.g. the lowest platform, above the diverter system. Diverter systems for offshore drilling rigs are typically provided beneath the drilling rig rotary table. Such a diverter system provides a vent line and ensures that the flow may be directed away from the drilling rig. Hence, in some embodiments, the offshore drilling rig comprises a diverter system under the first well centre.

At least parts of the drill floor deck may be formed by the roof of a housing or enclosure accommodating mud mixing equipment and/or other operational equipment of the drilling rig, thus allowing for a compact and space-saving arrangement of equipment on the drilling rig. For example, the drill floor deck may comprise a storage area for storing pipes, e.g. a storage area for storing pipes in horizontal orientation. The storage area may be located next to the horizontal pipe handling device or, if this is movable, next to the pipe feeding path along which the horizontal pipe handling device may travel. In some embodiments, the pipe storage area and/or horizontal pipe handling equipment may be partially or completely surrounded by open drill floor deck area, e.g. drill floor deck area shaped and sized to allow vehicles or skiddable items to be moved around the pipe storage area.

In some embodiments, the drill floor deck comprises at least a first open or unobstructed drill floor deck area located adjacent to the first mast, e.g. in the longitudinal or transverse direction of the first mast, other than any drill floor deck area used for movement of tubular equipment to the first well centre, and free of any mast or tubular storage structures or other fixed installations. Hence, the open drill floor deck area extends outside the mast structure. Consequently, the drilling rig provides an open or free drill floor deck area for placing and/or moving auxiliary equipment and/or for handling and/or operating such auxiliary equipment while at the same time allowing efficient and safe access to the well centre. Examples of such auxiliary equipment include logging-while-drilling equipment, measuring-while-drilling equipment, coiled tubing equipment, etc. and similar equipment other than the tubulars making up the drill string, well casing/lining or risers and other than heavy well-control equipment such as BOPs and Christmas trees. Generally, auxiliary equipment may comprise on-deck auxiliary equipment and suspendable auxiliary equipment such as down-hole equipment that may be hoisted through the well centre from a gantry or mounting structure. For example, auxiliary equipment may comprise a suspendable component and an on-deck component e.g. a reel on which coiled tubing or wire is spooled for use for suspending the suspendable component through the well centre. Other examples of on-deck auxiliary components comprise supply and/or similar support components for supplying the suspendable component with energy or other supplies that otherwise support the suspendable equipment.

In some embodiments, the drilling rig is configured to perform movement of tubular equipment, in particular risers, casing, liner, elements of the drill string, to the first well centre along a first pipe feeding path that only crosses drill floor deck areas outside the first open drill floor deck area. Consequently, handling and/or operation of the auxiliary equipment may be performed without interfering with the running of the tubular equipment through the well centre, i.e. away from the critical path of the drilling operation. Handling of auxiliary equipment may e.g. include preparation of suspendable auxiliary equipment such as sensors, robots, drones that are to be lowered into the drilled well at a later point in time. The offshore drilling rig may thus be configured, during all movement of tubular equipment to the first well centre, to keep the first open drill floor deck area free of said tubular equipment being moved to the first well centre. In particular, in some embodiments, the first open drill floor deck area is not occupied and/or cannot be occupied by neither a horizontal pipe handling equipment or by vertical pipe handling equipment. In particular, the open drill floor deck areas are free of any rails, guides or skid beams of the catwalk machine or other tubular feeding machines. Handling of auxiliary equipment may further be performed in a safe manner sufficiently remote from the normal drilling operation. An open drill floor deck area may even be sized and shaped to allow on-deck auxiliary equipment to be fixedly installed, i.e. during the entire drilling operation or at least stages thereof.

To this end, the first open drill floor deck area may be larger than 1 m in both directions (e.g. 1 m by 1 m or 1 m by 5 m), such as larger than 2 m in both directions, such as larger than 3 m in both directions, such as larger than 4 m in both directions, such as more than 5 m in both directions. In some embodiments, the first open drill floor deck area may be at least 4 $m^2$ large, e.g. at least 10 $m^2$, e.g. at least 15 $m^2$, e.g. at least 25 $m^2$, e.g. at least 35 $m^2$, e.g. at least 50 $m^2$, e.g. at least 65 $m^2$, e.g. at least 80 $m^2$, 100 $m^2$ large, e.g. at least 200 $m^2$, such as at least 500 $m^2$, such as at least 1000 $m^2$, such as at least 2000 $m^2$, e.g. at least 5000 $m^2$. The open drill floor deck area may cover at least a sector of a circle around the well centre having a radius of at least 2 m, such as 3 m, such as 4 m, such as 5 m, such as 6 m, such as 8 m, such as 9 m, such as 10 m, such as 15 m, such as 20 m, such as 30 m, the sector having a central angle of at least 60°, such as at least 90°, e.g. at least 120°.

In some embodiments, one or more of the open drill floor deck areas are accessible with a crane, such as a knuckle boom crane, so that relatively large equipment may be lifted on or off the open drill floor deck area. In some embodiments, the drilling vessel comprises such a crane, e.g. a crane having a boom length of between 5 m and 50 m or more, such as between 10 m and 30 m, such as between 10 m and 35 m, such as between 10 m and 30 m. In some embodiments the open drill floor deck area is configured to receive equipment of more than 3 t, e.g. more than 5 t, e.g. more than 10 t, e.g. more than 15 t, e.g. more than 20 t. Such equipment may be auxiliary equipment as discussed below.

In some embodiments, the open drill floor deck area has a free height of at least 3 m, such as at least 5 m, such as at least 6 m, such as at least 8 m, such as at least 10 m, such as at least 20 m, e.g. at least 30 m.

The term open drill floor deck area is intended to refer to a part of the drill floor deck that is free of pipe handling equipment, at least fixedly installed pipe handling equipment, during normal drilling operation such as drilling, making and breaking stands, running and tripping tubulars. Pipe handling equipment refers to equipment for drilling, making and breaking stands, running and tripping tubulars. The term normal drilling operation is further intended to refer to operations other than exceptional operations such as repair, maintenance work, or the like. The term fixedly installed equipment is intended to refer to equipment that is not movable during normal operation of the drilling rig, e.g. not skiddable or otherwise displacable. In some embodiments, the open drill floor deck area is further free of coiled tubing equipment, at least fixedly installed coiled tubing equipment, during normal drilling operation. In some embodiments, the open drill floor deck area is further free of heavy well-control equipment during normal drilling operation. Here the term well-control equipment refers to equipment such as blow out preventers or Christmas trees or similar assembly of valves, spools, and fittings that are installed under the drilling rig during the drilling operation. The term well-control equipment does not refer to tubular equipment such as risers. In some embodiments, the open drill floor deck area is not used during normal drilling operation for moving tubular equipment, coiled tubing and/or heavy well-control equipment to/from the well centre.

When the first open drill floor deck area comprises an access path extending outside the footprint of the first mast, auxiliary equipment may easily be moved to/from the first well centre. The access path may allow free access from the entire first open drill floor deck area to the first well centre without entering the footprint of the mast. The access path may provide a free height of at least 3 m, such as at least 5 m, such as at least 6 m, such as at least 7 m, such as at least 8 m, such as at least 10 m, such as at least 15 m, such as at least 20 m, thus allowing even tall items to be moved. For example, while the open drill floor deck area is generally free of pipe handling equipment during normal drilling operations, in certain exceptional situations it may be desirable to move tubular equipment such as risers to the open drill floor deck area, e.g. for repair or maintenance work. Such operations may thus be performed conveniently and safely without interfering with the normal drilling operation. When the access path is a straight path, e.g. extending in the longitudinal or transverse direction, particularly convenient access is provided. Similarly, when the access path is short, e.g. less than 20 m such as less than 10 m, efficient access is provided. When the access path is wide enough to allow vehicles such as forklifts and/or skiddable items moving along skid beams to move between the open drill floor deck area and the well centre, the efficiency of the drilling rig is increased. For example, the access path may be at least 2 m wide, such as at least 3 m e.g. at least 5 m wide.

In some embodiments, the drilling rig comprises access paths to the well centre from two, three or even from all four sides, i.e. from both longitudinal directions and from both transverse directions.

In some embodiments, the drilling rig comprises a guard structure configured to prevent tubular equipment operated above the first well centre from falling onto the drill floor deck area in a direction away from the first mast. The guard structure may be configured to guard at least part of (such as all of) the first open drill floor deck area from such falling tubular equipment. The guard structure may be a lateral guard structure extending, e.g. along the longitudinal direction, between support structures located on respective sides of the first well centre; one of the support structures may be the first mast. Consequently, even during ongoing drilling operations, auxiliary equipment may be handled and/or placed safely within the first open drill floor deck area. The guard structure may be formed completely or partially from one or more beams, chains, or similar structures; it may be located at a suitable elevation above the drill floor deck, low enough to allow tubular equipment to be caught and in some embodiments high enough to allow auxiliary equipment to be moved underneath. In some embodiments, the guard structure may comprise guards arranged at respective heights and/or guards that are movable between respective heights e.g. to allow catching of tubular equipment of various length such as pipes and stands. For example, the guard structure may be elevated above the drill floor deck at least 2 m, such as at least 3 m, such as at least 5 m, such as at least 6 m, such as at least 7 m, such as at least 8 m, such as at least 10 m, such as at least 15 m, such as at least 20 m, such as at least 30 m, such as at least 40 m; the guard structure may be elevated less than 30 m, such as less than 25 m, such as less than 20 m, such as less than 15 m, such as less than 10 m, such as less than 8 m, such as less than 7 m, such as less than 6 m, such as less than 5 m, such as less than 3 m. In embodiments, where the drilling rig comprises a pipe storage structure on a second side of the first well centre opposite the first side where the mast is located, the guard structure may extend between and be connected to the first mast and the pipe storage structure.

In some embodiments, the guard structure may be movable between a closed position where it prevents tubular equipment operated above the first well centre from falling onto the first open drill floor deck area and an open position where it allows increased lateral access, e.g. without height restriction, to the first well centre from the area which it is configured to guard. For example, the guard structure may be hinged or horizontally or vertically slidable. As noted above, the guard structure may comprise parts at various heights, some or all of which may be opened. Also, it may be desirable to move the guard structure during use of a support structure as described herein. Alternatively or additionally, the guard structure may be operable to be moved to different elevations.

In some embodiments, an offshore drilling rig comprises a gantry structure or another suitable mounting structure for suspending suspendable auxiliary equipment from an elevated position above the drill floor deck, allowing the auxiliary equipment to be lowered or hoisted through the first well centre; wherein the mounting structure is movable between a lower position for rigging up auxiliary equipment to the mounting structure, and an elevated position allowing lowering or hoisting of auxiliary equipment suspended from the mounting structure through the first well centre.

In some embodiments, the mounting structure may extend along the longitudinal direction from a first mast that is longitudinally displaced from the well centre as described herein. The mounting structure may comprise devices, such as one or more hooks, sheaves, pulleys, guide members such as guide arches, and/or one or more other connection mechanisms and/or devices for supporting cables or wires or coiled tubing for on-deck connecting auxiliary equipment positioned on the drill floor deck, e.g. on the open drill floor deck areas with suspendable auxiliary equipment such as downhole tools to be advanced towards the seafloor. The mounting structure is different from the hoisting system and preferably operable independently of the hoisting system.

It will be appreciated that a mounting structure as described herein may be used in combination with various embodiments of a drilling rig comprising a drill floor deck having a hole defining a first well centre; a first mast upwardly extending relative to the drill floor deck, and a first hoisting system supported by the first mast and configured for hoisting and lowering tubular equipment through the first well centre.

Consequently, suspendable auxiliary equipment to be lowered through the well centre may conveniently, efficiently and safely be prepared, rigged up and brought into an operational position without the need for human operators climbing at unsafe heights. In particular, when the mounting structure is in its lower position, a connection mechanism of the mounting structure for connecting auxiliary equipment to the mounting structure is made conveniently accessible to human operators from the drill floor deck; for example, the lower position may be no more than 3 m, such as no more than 2.5 m above drill floor deck, such as no more than 2 m, such as no more than 1.5 m. The elevated position may be at least, 3 m, 5 m, 6 m, 8 m, or 10 m above the drill floor deck, such as at least 15 m above the drill floor deck, e.g. at least 20 m above the drill floor deck.

When the mounting structure is arranged laterally displaced from the well centre, e.g. connected to one of the corners or sides of the mast facing the open drill floor deck area, the preparation of the auxiliary equipment and its connection to the mounting structure may conveniently be performed from the first open drill floor deck area without or at least with minimal interference with any ongoing drilling operation. In some embodiments, the lateral displacement is more than 0.5 m, such as more than 1 m, such as more than 2 m, such as more than 3 m, such as more than 4 m, such as more than 5 m, such as more than 6 m, such as more than 7 m, such as more than 10 m, such as more than 15 m, such as more than 20 m; at the same time less than 100 m, such a less than 75 m, such as less than 50 m, such as less than 25 m, such as less than 15 m, such as less than 10 m, such as less than 7 m, such as less than 5 m, such as less than 3 m, such as less than 2 m, such as less than 7 m. In some embodiments, the height of the support structure and the lateral displacement from the well centre are arranged to allow a suitable angle and/or bend radius for suspended wire connecting the suspendable auxiliary equipment through the well centre. To this end, in some embodiments, the first open drill floor deck area allows a spacing of any on-deck auxiliary equipment, such as reels of spooled wire or coiled tubing or other on-deck components supporting the suspendable auxiliary equipment, from the support structure (measured on the drill floor deck) of more than 1 m, such as more than 2 m, such as more than 3 m, such as more than 4 m, such as more than 5 m, such as more than 6 m, such as more than 7 m, such as more than 10 m, such as more than 15 m, such as more than 20 m.

The mounting structure may e.g. comprise a beam or similar elongated structure that may be slidably arranged on rails or tracks on the mast and on a corresponding structure, e.g. a pipe storage structure, on a second side of the well centre opposite the first side where the mast is located. The mounting structure may be part of or separate from a guard structure as described herein.

In some embodiments, the first mast and the first hoisting system are configured to allow tubular equipment to be moved towards the first well centre along the longitudinal direction from the first side, i.e. the same side on which the mast is located. Consequently, in some embodiments, tubular equipment may be moved to the well centre from both sides of the well centre (in the longitudinal direction), thus allowing tubular equipment from multiple storage areas and using different pipe handling equipment to be moved while keeping the open drill floor deck area free.

To this end, the first mast and the first hoisting system may define an opening through which tubular equipment is movable towards the first well centre from the first side. In particular, in some embodiments, the first hoisting system comprises a plurality of cylinders extending upwards relative to the drill floor deck, wherein the cylinders are arranged as at least two groups of cylinders that are laterally spaced apart from each other so as to allow tubular equipment to be moved towards the well centre from the first side along the longitudinal direction through a gap between the two groups of cylinders. Consequently, a central and direct pipe feeding path for tubulars to the well centre is provided. Each group of cylinders may comprise one or more cylinders, e.g. 2, 3, or even more cylinders, depending on the desired hoist capacity. The well centre may be longitidinally displaced from an area between the two groups of cylinders so as to allow access to the well centre also from the transverse direction. The drilling rig may thus further comprise a pipe storage structure and pipe handling equipment positioned longitudinally displaced from the first well centre on the first side of the first well centre. For example, risers and/or another type of tubulars (such as those mentioned above) may be stored on the first side of the mast (i.e. on the opposite site from the well centre), while other types of tubulars, such as pipes and/or casings, may be stored and/or assembled to stands on the second side, opposite the first side. In some embodiments, the pipe storage structure on the first side is to support heavier tubular equipment such as riser sections and/or casing. In some embodiments, this pipe storage structure on the first side is arranged to store tubulars in vertical position. The pipe storage structure may be located at the same level as the drill floor deck or at least partially at a different level, e.g. a lower level so as to allow tubulars to be advanced along a sloping direction through the opening in the hoisting system.

The drilling rig may further comprise a pipe storage structure, e.g. providing a setback area for storing assembled stands of pipes, positioned on a second side of the first well centre opposite the first side. Again, this pipe storage structure may be located at the same level as the drill floor deck or at least partially at a different level, e.g. a lower level so as to allow tubulars to be advanced along a sloping direction.

When the first open drill floor deck area extends around the setback area to a side of the setback area distal from the first well centre, movable equipment may be moved around the first open drill floor deck area and around the setback area from one lateral side of the well centre to the other side without interfering with the drilling operation.

In some embodiments, the drilling rig is a dual (or even multiple) activity rig where more than one main drilling operations and/or parallel operations may be performed through two or even more separate well centres. To this end, in some embodiments, the offshore drilling rig further comprises a second well centre displaced from the first well centre, optionally a second mast upwardly extending relative to the drill floor deck, and a second hoisting system supported by the second mast and configured for hoisting and lowering tubular equipment through the second well centre.

In some embodiments, the positions of the first and second well centres together define a transverse direction within the plane of the drill floor deck; the first and second masts may be arranged side by side in the transverse direction or in another suitable configuration. The two masts may be integrated into one mast. In some embodiments, the position of the second well centre is place substantially along the longitudinal direction; the first and second masts may be arranged opposite each other.

Hence, efficient dual (or even multiple) drilling activities may be carried out, and drilling crew and equipment may conveniently be moved between the well centres. Furthermore, operations at both well centres may conveniently be monitored and/or controlled, e.g. from a single control room having a direct line of sight to both well centres. Moreover, the well centres may be used as back-up/replacement for each other in a convenient manner, because storage areas, pipe handling equipment etc. serving both well centres may be arranged to efficiently serve/cooperate with both well centres.

The capacity of the equipment related to the first and second well centres, e.g. the respective masts, parts of a common mast, hoisting systems, etc., may be different e.g. they may have different hoist capacity, or they may have equal hoist capacity and/or be otherwise identical or at least interchangeably usable for drilling operations. The equipment related to the second well centre may comprise and/or cooperate with the same or corresponding features, elements, components or devices already discussed in connection with the first mast and/or the first well centre. For example, the second mast may comprise or cooperate with a guard structure and/or a mounting structure as described herein. The first and second masts may be separate structures or combined as a single mast structure. For example, the first and second masts may be embodied as a combined mast supporting first and second hoisting systems.

The term main drilling operation is intended to refer to the actual drilling operation where the drill string is advanced through a riser to and into the sea floor. Parallel operations refer to operations using a well centre which may be performed parallel or simultaneous with the main drilling operation; they may include the building up of stands of tubulars, advancing of tubular equipment towards or to the sea floor, drilling of a top hole, and or the like. Accordingly, the drilling rig is configured to advance risers to the seafloor through at least the first well centre, and the drilling rig comprises a diverter located under the drill floor deck at the first well centre. In some embodiments, the drilling rig is configured to allow drilling operations to be performed through both well centres, i.e. both well centres, masts, and hoisting systems may be configured to allow risers and the drill string to be advanced all the way to the seabed. In some embodiments, the second mast and/or the second hoisting system may be configured to operate as an auxiliary system, e.g. for running risers, building stands, and or the like. In some embodiments, the second hoisting system may have a different, e.g. smaller, hoist capacity as the first hoisting system. Nevertheless, even in such embodiments, the second mast, hoisting system and well centre may be suitable for taking over the primary drilling operation, e.g. in situations when the first mast, hoisting system or well centre is out of order. In other words, any of the features above discussed in relation to the first well centre may further be arranged in relation to the second well centre, as a combined feature for both well centres or a feature in relation to the second well centre alone.

In some embodiments, the offshore drilling rig thus further comprises second pipe handling equipment, wherein the first pipe handling equipment defines a first pipe feeding path, e.g. substantially along the longitudinal direction, across the transverse direction, along which pipe feeding path tubular equipment is moved towards the first well centre; and wherein the second pipe handling equipment defines a second pipe feeding path, e.g. substantially along the longitudinal direction, along which tubular equipment is moved towards the second well centre. In some embodiments, tubular equipment may be moved in parallel to both well centres. In some embodiments, the tubulars may be moved from a common storage structure such as when tubular equipment are moved to the well centres from the same side. This allows for a more efficient operation of the rig, and providing a higher degree of flexibility and redundancy of critical components.

In some embodiments, the drilling rig may comprise two diverter housings, one positioned under each well centre.

Some embodiments of the offshore drilling rig comprise a pipe storage structure positioned longitudinally displaced from the first well centre on a second side of the well centre, opposite the first side and laterally positioned between the first and the second pipe feeding paths.

As noted above, any feature discussed in relation to the first well centre may be present in relation to the second well centre, including an open drill floor deck are—referred to as a second open drill floor deck area. In some embodiments, the drill floor deck comprises at least a first open drill floor deck area located adjacent to the first mast in the transverse direction on a side opposite the second well centre, and a second open drill floor deck area located adjacent to the second mast in the transverse direction on a side opposite the first well centre. The first and second drill floor deck areas are thus areas other than the drill floor deck area between the first and second well centres and other than any drill floor deck area used for movement of tubular equipment to the first well centre. Consequently, open drill floor deck areas are provided on both lateral sides of the well centres, thus further increasing the flexibility and efficiency of the rig, as auxiliary equipment may be stored and/or handled on both sides of the mast and moved to/from both well centres without interfering with the drilling operation at the other well centre. In particular, in some embodiments, the drilling rig is configured to perform movement of tubular equipment to the first and second well centres along respective first and second pipe feeding paths towards the respective first and second well centres which first and second pipe feeding paths only cross drill floor deck areas outside the first and second open drill floor deck areas.

When each of the first and second open drill floor deck areas comprise an access path extending outside the footprint of the first and second masts and along the transverse direction to the first and second well centres, auxiliary equipment may be moved directly between both open drill floor deck areas and the respective well centres.

When the first and second open drill floor deck areas are connected with each other by a connecting drill floor deck area, equipment may conveniently be moved between the open drill floor deck areas without interfering with the drilling operations. The connecting drill floor deck area may thus be shaped and sized so as to allow equipment to be moved between the open drill floor deck areas, e.g. by means of a forklift and/or on skid beams, without having to climb or descend onto different deck levels. For example, the connecting drill floor deck area may define a connecting path between the first and second open drill floor areas having a width of at least 2 m, such as at least 3 m, such as at least 5 m. In some embodiments, the connecting drill floor deck area extends around the pipe storage structure on a side of the pipe storage structure distal from the first and second well centres.

BRIEF DESCRIPTION OF THE DRAWINGS

The above and/or additional objects, features and advantages of embodiments and aspects of the present invention, will be further elucidated by the following illustrative and non-limiting detailed description with reference to the appended drawings, wherein:

FIGS. 1-8 illustrate views of an embodiment of an off-shore drilling rig wherein FIG. 1 shows a 3D view of the drilling rig, FIGS. 2-6 show 3D views of parts of the drilling rig from different viewpoints, FIG. 7 shows a cross-sectional view of the drilling rig in a longitudinal plane through the centre of the drilling rig, looking in the transverse direction, and FIG. 8 shows a top view of the drilling rig.

DETAILED DESCRIPTION

Figure 1:
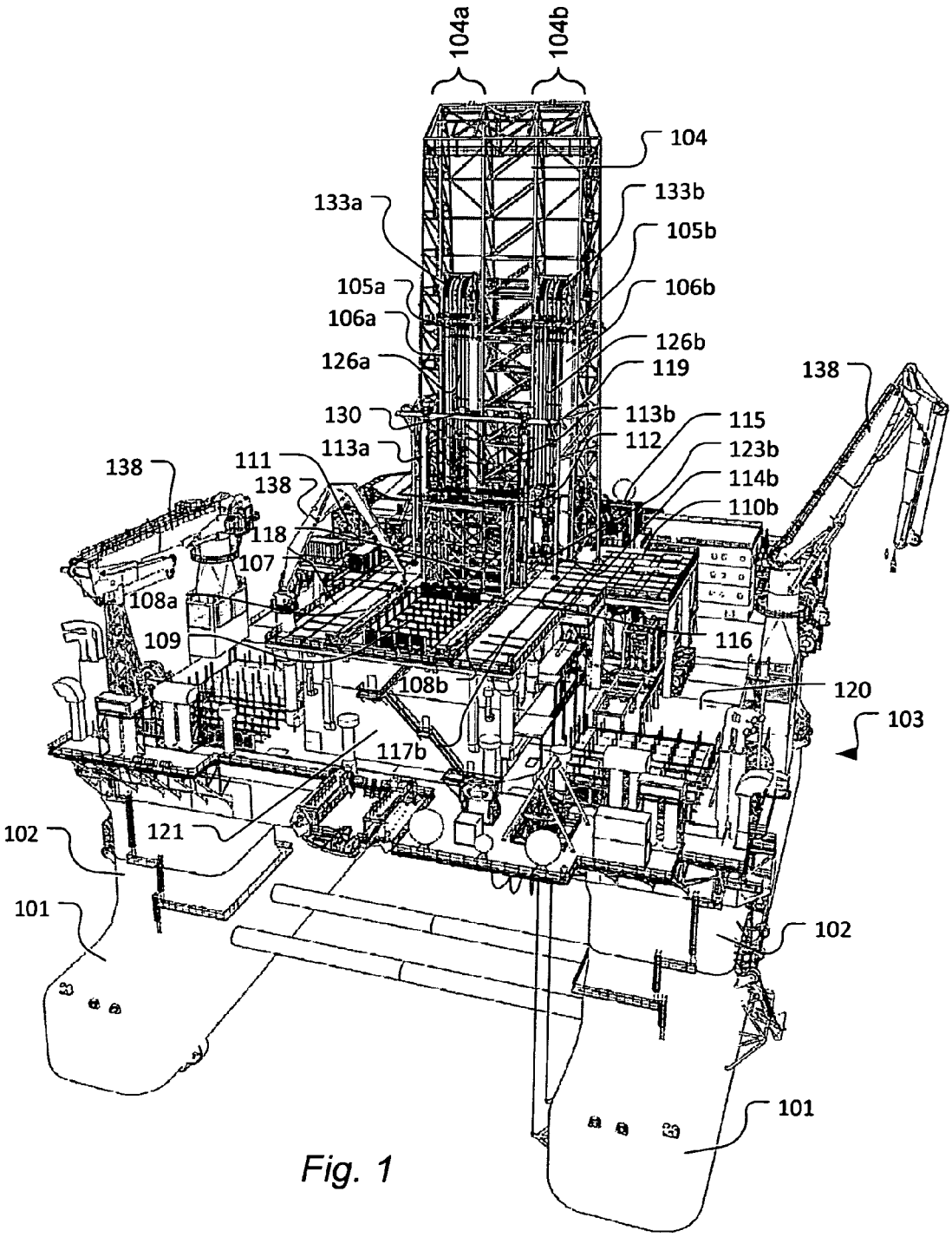

In the following description, reference is made to the accompanying figures, which show by way of illustration how the invention may be practiced.

An embodiment of an off-shore drilling rig will be described with reference to FIGS. 1-8.

The drilling rig is a semisubmersible drilling rig, comprising pontoons 101 from which support columns 102 extend upwardly, and a topside platform 103 supported by the columns 102. During operation, the drilling rig floats at the ocean surface with the pontoons 101 under the water and the support columns extending out of the water such that the topside platform is elevated above the water. To this end, the pontoons may be filled with ballast water so as to cause the rig to be submersed to the desired level.

The topside platform comprises a drill floor deck 107 arranged elevated from a main deck 120 and partly formed by the roof of an enclosure 121 accommodating mud mixing equipment and/or other equipment. The drill floor deck 107 comprises two holes defining well centres 123*a,b* located next to a dual activity mast 104. The dual activity mast 104 extends upwardly from the drill floor deck 107 and comprises two mast portions 104*a,b* arranged side by side in the transverse direction. Each mast portion supports a respective hydraulic hoisting system 105*a,b*, each for lowering a drill string through a respective one of the well centres 123*a,b* towards the seabed. Each hydraulic hoisting system comprises cylinders 106*a,b*, respectively, that extend upwardly from the drill floor deck and support the load to be lowered or hoisted. Each well centre is located next to one of the mast portions and the corresponding hoisting system, and both well centres are located on the same side relative to the mast. The position of each of the well centres relative to the corresponding hoisting system defines a longitudinal direction, in this example the longitudinal direction of the drilling rig, i.e. between bow and aft of the drilling rig. The well centres are arranged along a transverse direction, normal to the longitudinal direction, in this example the transverse direction (from port to starboard) of the drilling rig. The longitudinal and transverse directions are indicated by arrows 140 and 141, respectively, in FIG. 8.

The cylinders of each hoisting system are arranged in two groups that are positioned displaced from each other in the transverse direction so as to form a gap 126*a,b*, respectively, between the two groups. Each gap 126*a,b* is thus aligned with a respective one of the well centres along the longitudinal direction. Each gap extends upwardly along the entire length of the cylinders, thus allowing tubulars to be moved through the gap towards the respective well centre and even raised into an upright position while being located at least partly in the gap between the cylinders. The well centre is longitudinally displaced from the gap. The rods of the cylinders support sheaves 133*a,b*, respectively, of a travelling yoke over which the hoisting wires are suspended. One end of the hoisting wires is anchored to the drilling rig, while the other end is connected to top drive 137*a,b* or hook of the corresponding hoisting system. The sheaves 133*a,b* are laterally supported and guided by the respective mast portions.

The side-by-side configuration of the dual activity mast and well centres allows efficient dual operations, easy access to both well centres, and convenient visual control of both well centres from a single driller's cabin 134 which may e.g. be positioned transversely between the well centres, e.g. within the footprint of the mast.

The drilling rig comprises a setback structure 112 or similar pipe storage structure for storing stands of tubulars located on the other side (seen in longitudinal direction) of the well centres, opposite the mast. The setback structure comprises a support framework supporting fingerboards having horizontally extending fingers between which tubulars may be stored. The setback structure is arranged transversely between the transverse positions of the well centres so as to allow stands to be moved to/from both well centres from/to the setback. To this end, two column rackers 113*a,b* or similar vertical pipe handling equipment are arranged to move stands into and out of the setback structure 112. The column rackers are operable to move along the transverse direction along a support beam 130 spanning the transverse distance between the well centres. The support beam may be a part of the setback support framework. The setback structure 112 may extend downwards to a deck below the drill floor deck so as to allow stands assembled from multiple pipes to be stored and moved to a respective one of the well centres. The setback structure may comprise a foxhole and separate stand-building equipment, thus allowing stands of pipes to be assembled and stored without interfering with operations at the well centres. Alternatively or additionally, one of the hoisting systems and well centres, e.g. well centre 123*a,b* may be utilised for building stands.

A pipe storage area 109 for storing pipes in horizontal orientation is located behind the setback structure, seen from the well centres. On either transverse side of the pipe storage area respective catwalk machines 108*a,b*, or similar pipe handling equipment, are located extending in longitudinal direction, each aligned with one of the well centres. Each catwalk machine is operable to move pipes from the storage area 109 to the corresponding well centre and hoisting system. To this end, the pipes may be placed on the catwalk machine by a crane, e.g. one of the knuckleboom cranes 138, and the catwalk machine may be longitudinally moved to the corresponding well centre, e.g. on skid beams or tracks 139*a,b* defining a straight pipe feeding path to the corresponding well centre. Hence, the catwalk machines move tubular equipment along the corresponding pipe feeding paths 139*a,b* towards the corresponding well centre. The catwalk machines and tracks 139*a,b* thus define longitudinal pipe feeding paths, each intersection with one of the well centres. The pipe feeding paths 139*a,b* extend towards the well centres from a side of the well centres opposite the side on which the mast is located. The column rackers 113*a,b* may be transversely moved to a position on the pipe feeding path, i.e. in longitudinal extension of one of the catwalk machines. In this position, the column racker may thus receive a pipe from the catwalk machine and, in cooperation with the catwalk machine, bring the pipe in a vertical position.

The drilling rig comprises another storage area 115 on the other side of the mast, i.e. on the side opposite the well centres. This storage area is located at a lower deck than the drill floor deck, and it is used for storing risers in a vertical orientation. The risers may then be moved, e.g. by means of a gantry crane 136 and respective slides 132*a,b* or other suitable pipe feeding equipment to the respective well centres. As the risers may be moved through the gaps 126*a,b* between the cylinders 106*a,b* of the hoisting systems, the risers may be moved directly from the riser storage area 115 to the well centre in a space efficient manner.

As all tubulars are moved to the well centres from opposite sides of the well centres along the longitudinal direction, and since the setback structure 112 and the storage area 115 are located longitudinally displaced from the well centres, the drill floor deck 107 comprises large open drill floor deck areas 110*a,b* on both lateral sides of the mast and well centres. These open drill floor deck areas are not occupied by pipe handling equipment, and all pipe movements between the storage/setback areas 112, 115 and the well centres 123*a,b* are performed along the longitudinal direction. The pipe feeding paths along which the pipes and other tubulars are moved to/from the well centres do not cross the lateral open drill floor deck areas 110*a,b*. Consequently, these areas may be used as working area, e.g. for rigging up suspendable auxiliary equipment, and/or for positioning on-deck auxiliary equipment 111. In the example of FIGS. 1-8, the open drill floor deck area 110*a* is used for placing and/or moving on-deck auxiliary equipment and/or for handling and/or operating such auxiliary equipment while at the same time allowing efficient and safe access to the well centre. Open drill floor deck area 110*b* is kept free of any pipe handling equipment and any other permanently installed equipment; this area may thus be used as a working area and/or intermediate storage area. Both open drill floor deck areas 110*a,b* are connected with the well centres by direct, straight access paths 114*a,b*, respectively, thus allowing equipment to be conveniently moved between the open drill floor deck areas 110*a,b* and the well centres, e.g. on skid beams 116. Any work within open drill floor deck areas 110*a,b* does not interfere with pipe movements to/from the well centres or with other operations at the well centres.

The well centres are placed outside the footprint of the mast and longitudinally displaced relative to the cylinders 106*a,b*, and the access paths are not blocked by any other fixedly installed structures on the drill floor deck or structures elevated at a low height above the drill floor deck. Thus, convenient access between the open drill floor deck areas 110*a,b* and the well centres is provided.

The open drill floor deck areas even extend laterally along the catwalk machines, thus allowing equipment to be moved along the catwalk machines and/or stored on open drill floor deck areas 117*a,b* extending along each of the catwalk machines. In particular, as the catwalk machines are located on the drill floor deck and as the drill floor deck comprises a large floor area extending along the catwalk machines, crew members may work with or at the catwalk machines without any danger of falling. The parts 117*a,b* of the open drill floor deck area extending along the catwalk machines are large enough to allow skid beams to be installed, thus allowing equipment to be moved away from the lateral open drill floor deck areas 110*a,b*.

The lateral open drill floor deck areas 110*a,b* are even connected with each other by a connecting drill floor deck area 118, in this example a straight path of open drill floor deck area extending between the setback structure 112 and the pipe storage area 109. The connecting drill floor deck area 118 forms a path wide enough for skid beams to be installed or a fork lift to move along, thus allowing equipment to be conveniently moved from one of the lateral open drill floor deck areas 110*a,b* to the other, without having to traverse the well centres.

Figure 2:
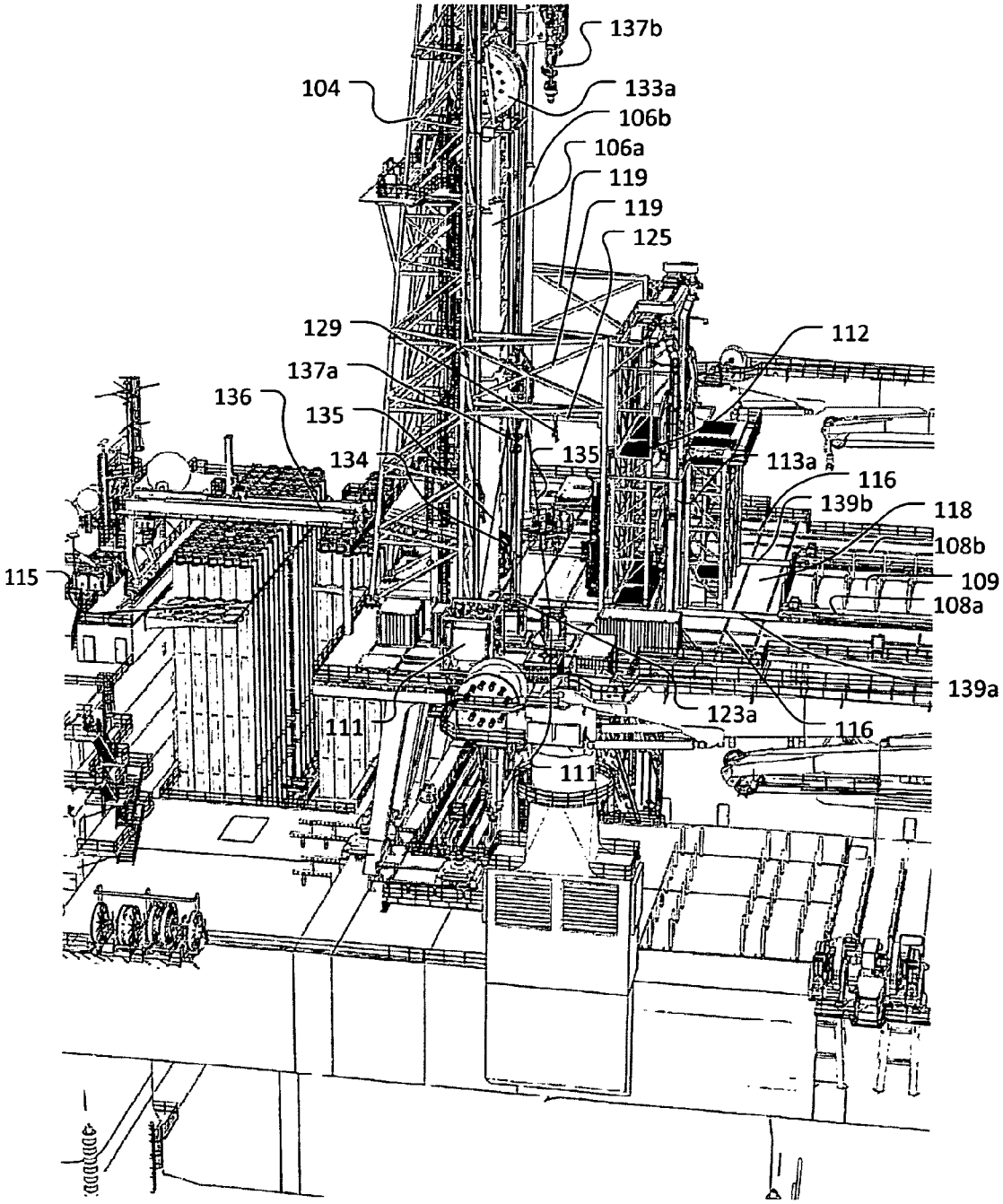
Figure 3:
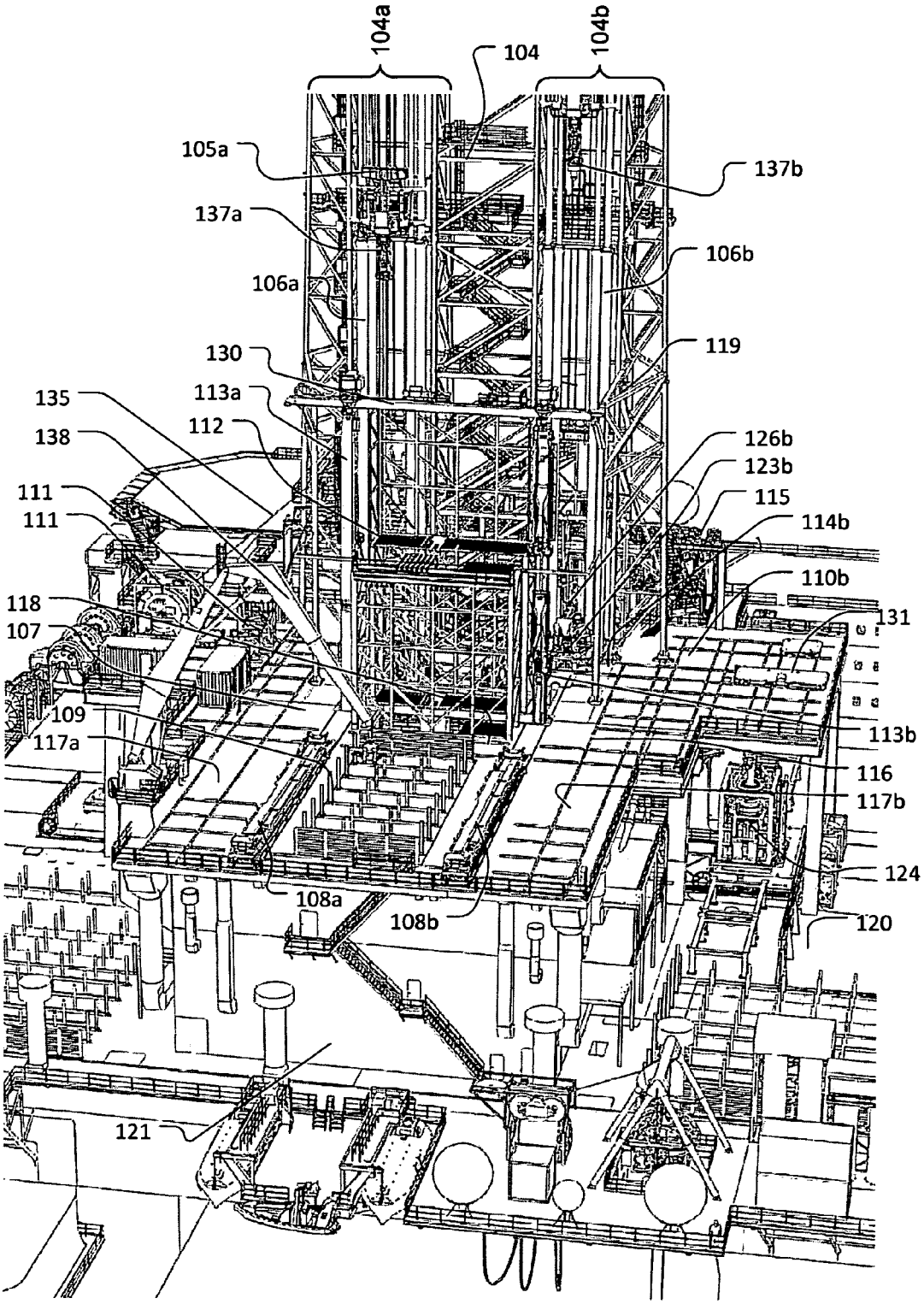
Figure 4:
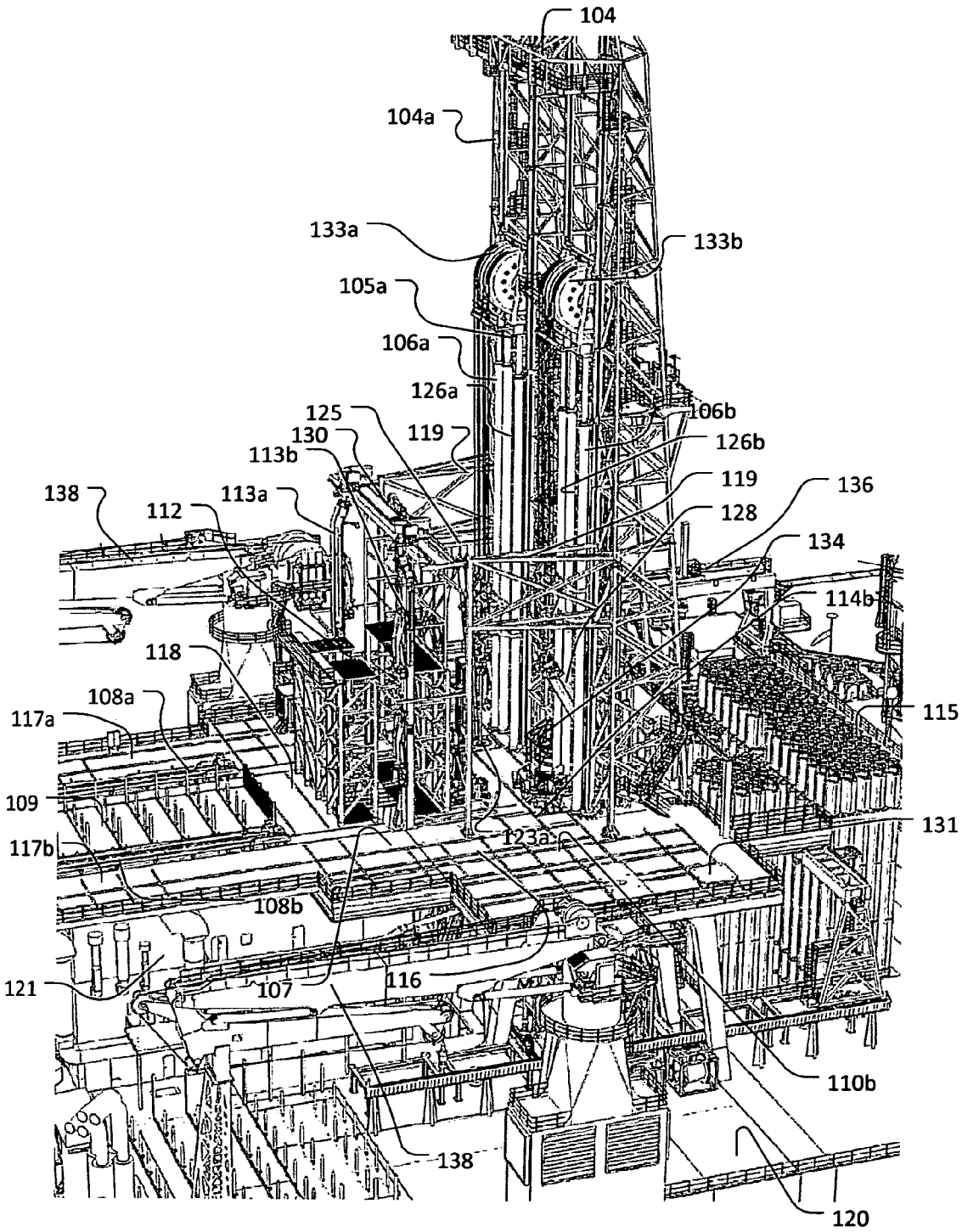

As is most easily seen in FIGS. 2 and 4, the drilling rig comprises guard structures 119 that extend in the longitudinal direction from respective lateral sides of the mast 104 to the support framework of the setback structure 112. It will be appreciated, however, that the guard structures 119 may be supported by a separate support structure. The guard structures span across the access paths 114*a,b* between the well centres and the respective open drill floor deck areas 110*a,b* at a height high enough to allow equipment to be moved under the guard structures. For example, the access paths 114*a,b* may have a free height of at least 3 m, such as at least 5 m, such as at least 6 m, such as at least 7 m, such as at least 8 m, such as at least 10 m, such as at least 15 m, such as at least 20 m, thus allowing even tall items to be moved. The guard structures are further located at a height above the drill floor deck that is suitable for preventing tubulars run through one of the well centres from falling on the open drill floor deck areas 110*a,b*. Consequently, equipment stored or even crew members working in one of the open drill floor deck areas 110*a,b* are protected against falling tubular equipment. In some embodiments, the height at which the guard structures are arranged may be adjustable. For example, the guard structures may be mounted to rails or tracks extending upwardly along the support structures to which the guard structures are mounted. The guard structures may then be lifted by wires or cables, by a hydraulic mechanism, or by another suitable hoisting mechanism. Hence, the guard structures may be positioned at different heights in accordance with the length of the tubular equipment run. Alternatively, the guard structure may be formed as separate structures that are arranged at different heights and/or whose height can be individually adjusted. In yet another embodiment the guard structures may be operable to be opened so as to allow unobstructed access to the well centre, even for equipment having a large height. For example, defective tubulars may need to be placed within one of the open drill floor deck areas 110*a,b*, so as to allow maintenance or repair of the defective equipment while the drilling operation continues. The guard structures may be opened in a number of different ways. For example, they may be hinged at one or both sides, or they may be slidable to a large height.

Figure 5:
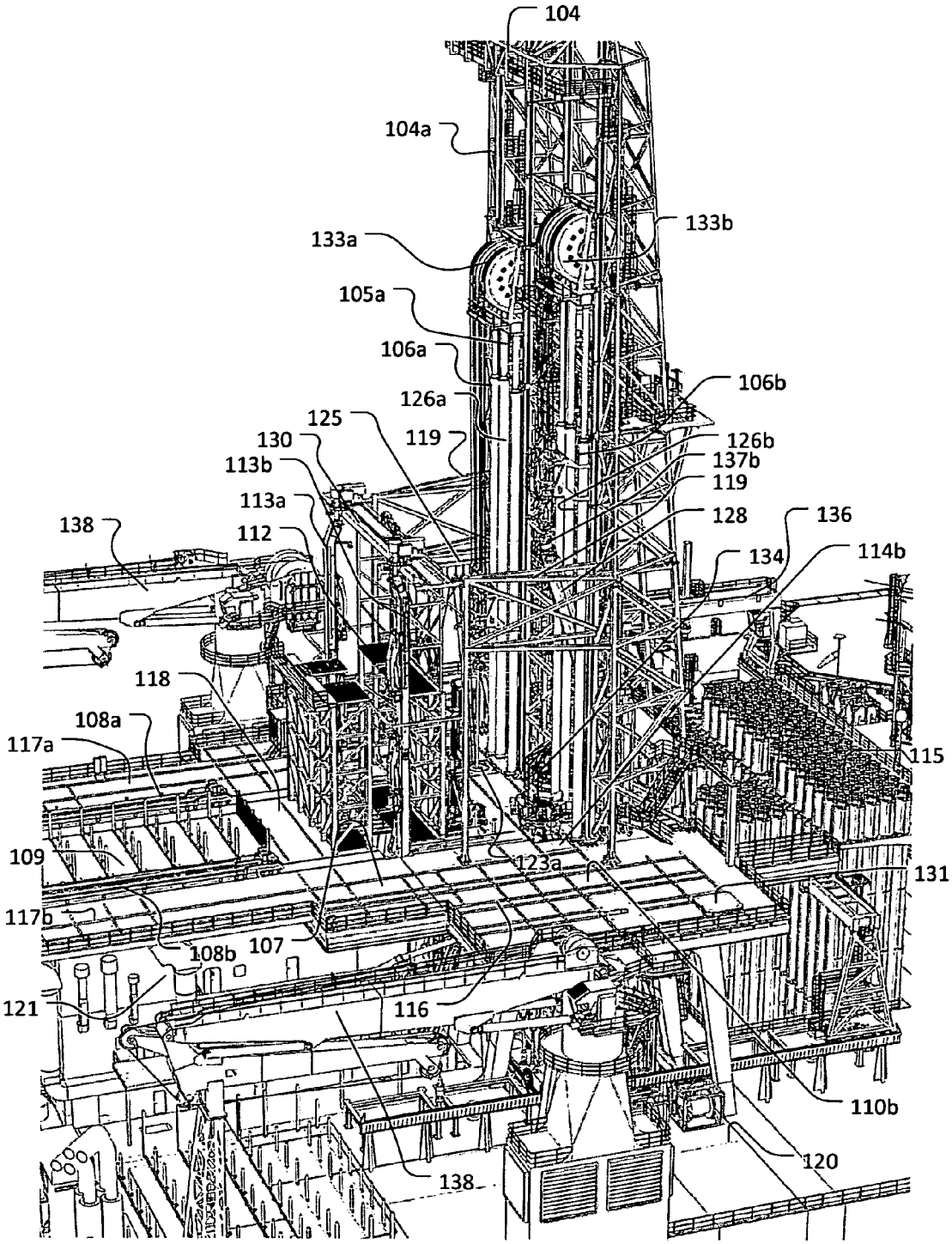
Figure 6:
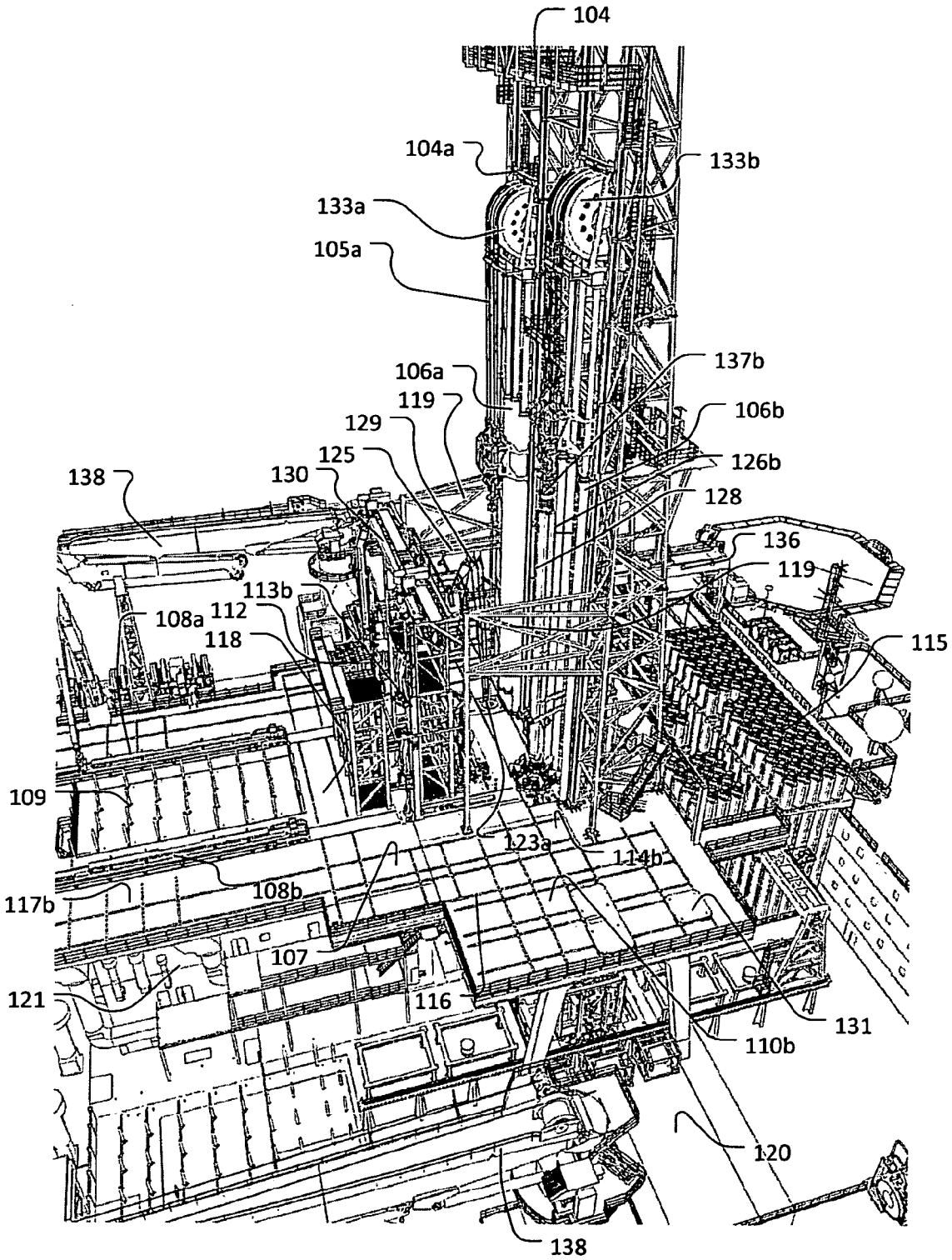
Figure 7:
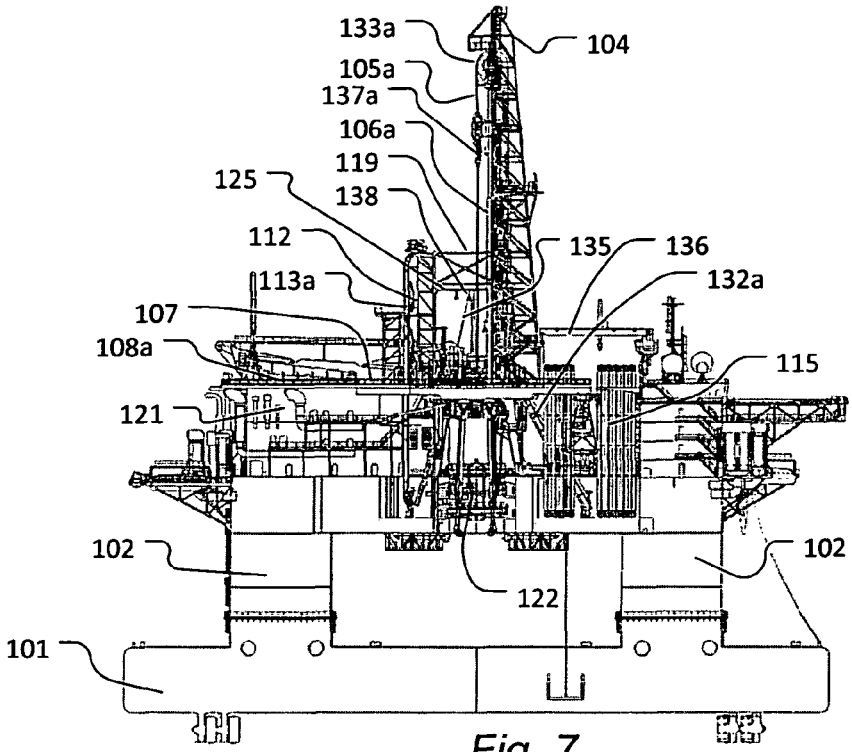

As is most easily seen in FIGS. 2 and 6, the drilling rig further comprises a gantry beam or framework 125 or a similar mounting structure for suspending suspendable auxiliary equipment from an elevated position above the drill floor deck, allowing the auxiliary equipment to be lowered or hoisted through the first well centre. The gantry beam 125 is connected to respective support structures on both longitudinal sides of the well centres and laterally displaced from the well centre. In this particular embodiment, the gantry beam is secured to the mast 104 and to the setback structure 112 and spans the access path 114*a* between the open drill floor deck area 110*a* and the well centres. The gantry beam 125 is operable to be hoisted and lowered at least between an operational position elevated above the drill floor deck, and a lower position immediately above the drill floor deck allowing the rigging up of auxiliary equipment to the mounting structure. For example, the lower position may be no more than 2 m above the drill floor deck. The elevated position may be at least, 3 m, 5 m, or 10 m above the drill floor deck, such as at least 15 m above the drill floor deck, e.g. at least 20 m above the drill floor deck. To this end, the gantry beam may be mounted on rails or tracks extending upwardly along the support structures to which the gantry beam is connected. The gantry beam may then be lifted by wires or cables, by a hydraulic mechanism, or by another suitable hoisting mechanism. For example, the gantry beam 125 and the guard structure 119 may be mounted to the same hoisting mechanism. In some embodiments, the gantry beam may even be a part of the guard structure. It will be appreciated that a gantry beam or similar mounting structure may be arranged proximal to, and operable with, each of the well centres or proximal to, and operable with, only one of the well centres as in the example of FIGS. 1-8.

When the gantry beam 125 is lowered to its lower position, the rig crew may conveniently rig up the gantry beam with suspendable equipment that is to be lowered through one of the well centres. Examples of such equipment include logging-while-drilling equipment, measuring-while-drilling equipment, coiled tubing equipment. To this end, the equipment to be lowered through the well centre may be connected to a wire, cable or coiled tubing 135 which in turn may be led via hooks, pulleys, guide arches and/or similar guide members 129 that are connected to the gantry beam 125 to reels, drums, or similar on-deck auxiliary equipment 111 positioned on one of the open drill floor deck areas 110*a,b*. The rigging up may thus be performed without any need for members of the drill crew to climb to unsafe heights. Moreover, the rigging up is performed away from the well centre, thus not interfering with any activity performed at the same time at the well centre. Once rigged up, the gantry beam 125 is hoisted to the desired height thus allowing lowering the suspendable auxiliary equipment through the well centre 123*a* at a suitable angle. The reels, drums or other on-deck auxiliary equipment 111 used for lowering the suspendable auxiliary equipment through the well centre may conveniently be positioned, e.g. skidded on skid beams 116, at a desired location within the open drill floor deck area 110*a*.

The main deck 120 is located beneath the drill floor deck and allows heavy well-control equipment 124, e.g. BOPs and Christmas trees to be moved to the moon pool 122 under the well centres so as to allow such equipment to be lowered toward the seabed. Consequently, the drill floor deck and, in particular, the part in close proximity to the well centre may be stationary and does not need to be hoisted or lowered for the well-control equipment to be lowered to the seabed.

One or more iron roughnecks 127 or similar pipe handling equipment may be arranged on the drill floor area in immediate proximity of the well centres. Such equipment may be arranged such that it may serve only one of the well centres or both well centres.

As may be most easily seen in FIGS. 4-6, risers may be moved directly from the riser storage area 115 through one of the gaps 126*a,b* to one of the well centres 123*a,b*. To this end, a riser may be moved by a gantry crane 136 from its position in the storage area 125 onto a slide 132*a,b*, respectively, or other suitable pipe feeding equipment, defining a slanted surface extending upwards and towards one of the gaps 126*a,b*. The riser may then be picked up by the top drive 137*a,b* of the corresponding hoisting system 105*a,b* and pulled into vertical position above the corresponding well centre 123*a,b*. FIG. 4 shows a riser 128 positioned on the slide 132*b* and extending through the gap 126*b* towards the well centre 123*b*. FIG. 5 shows the riser connected to the top drive 137*b* of the hoisting system 105*b* and in the process of being hoisted upwards and through the gap 126*b* towards the well centre 123*b*. FIG. 6 shows the riser after being hoisted into a vertical position above the well centre 123*b* and ready to be lowered through the well centre 123*b*.

Figure 8:
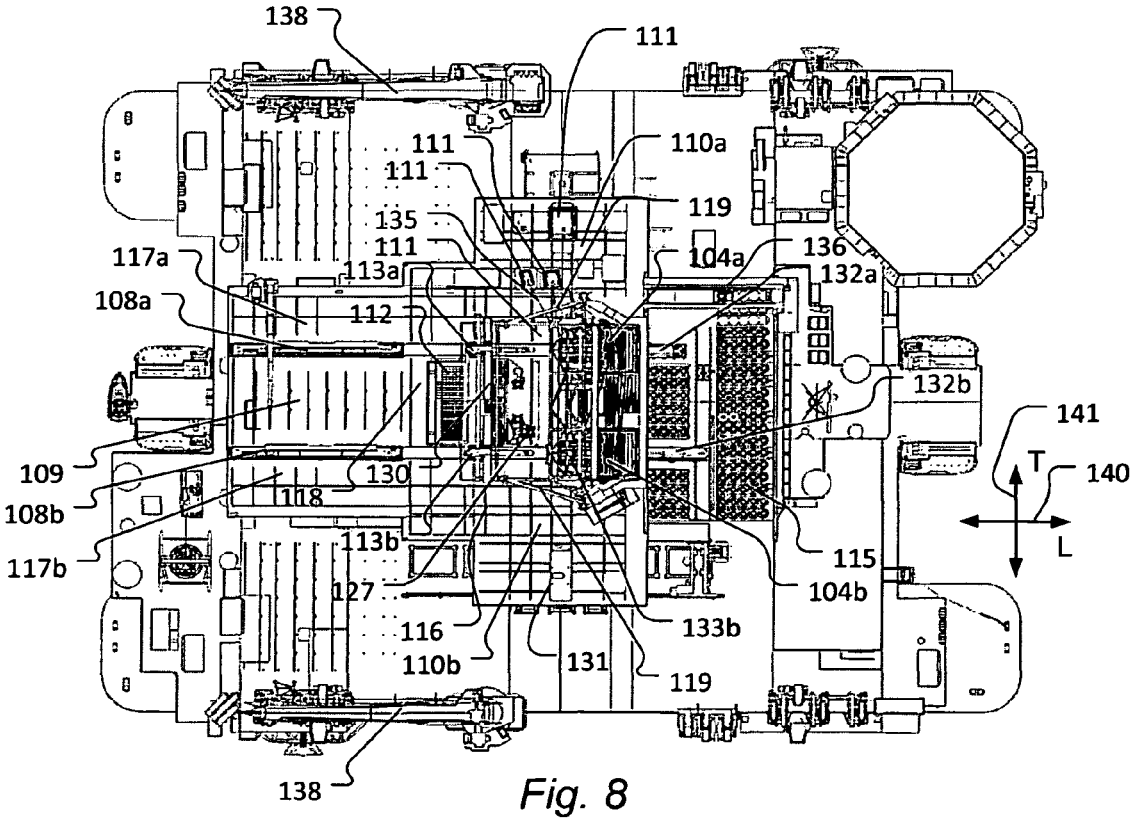

As is most easily seen in FIG. 8, the drilling rig comprises access paths to the well centre from all four sides, i.e. from both longitudinal directions and from both transverse directions. Moreover, the symmetrical arrangement of the mast, the well centres and the pipe storage and handling equipment allow tubulars from all storage areas to be efficiently moved to both well centres. In some embodiments, both mast portions and hoisting systems may be designed in a similar or even identical fashion and provide similar or even equal hoisting capacity. Consequently, full redundancy of the dual drilling system may be achieved. It will be understood, however, that the dual system may alternatively be designed with a primary and a secondary well centre/hoisting system. In such embodiments, a certain degree of redundancy may still be achieved.

Figure 9:
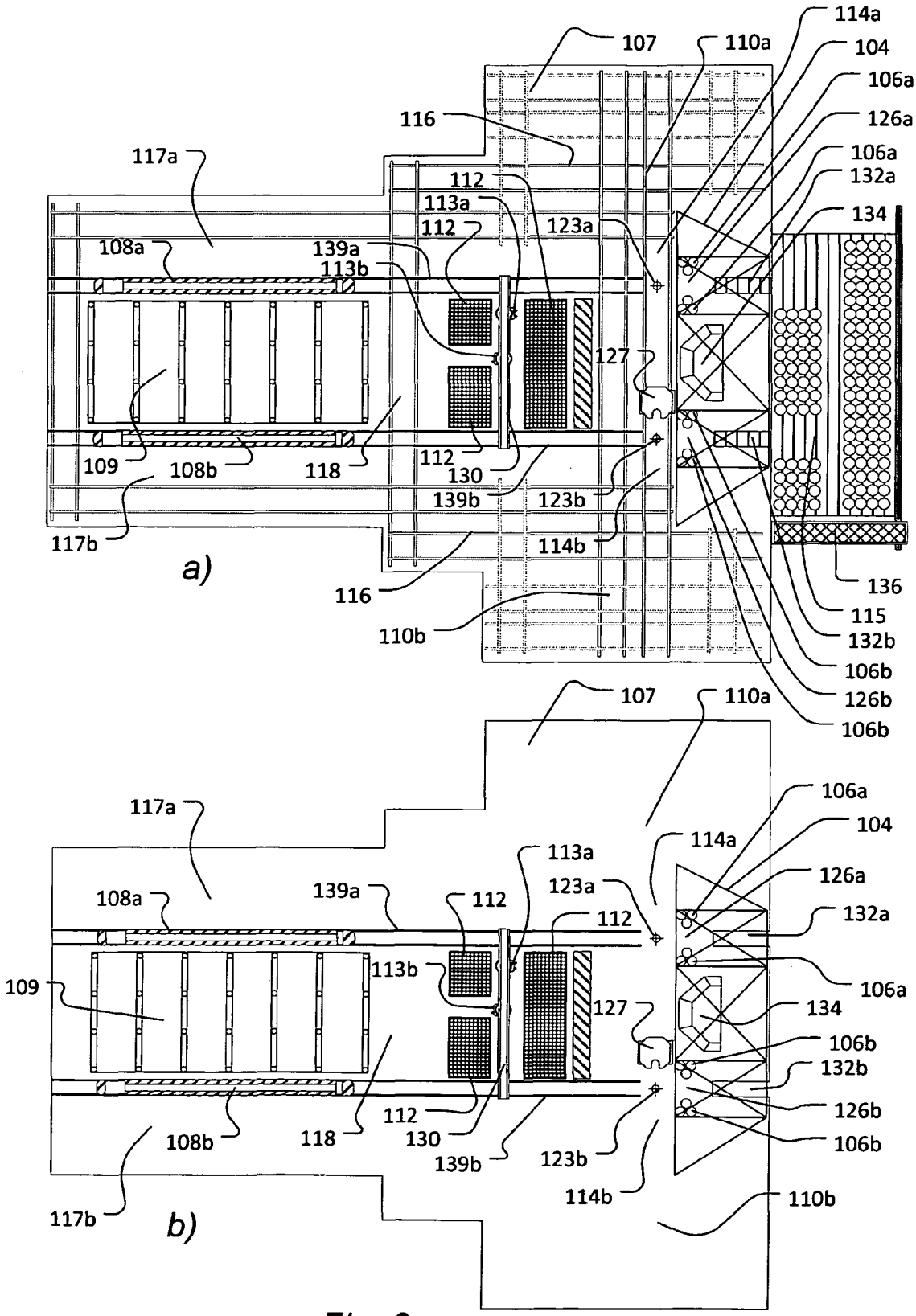
FIGS. 9*a* and *b* schematically illustrates further embodiments of the deck layout of the drill floor deck of a drilling rig.

FIG. 9 shows top views of another example of a drill floor deck 107. FIG. 9*a* shows the drill floor deck and adjacent storage area 115 for risers, while FIG. 9*b* only shows the drill floor deck. Furthermore, while FIG. 9*a* shows the skid beams 116 arranged throughout the drill floor deck, the skid beams are not shown in FIG. 9*b* for the purpose of a simpler illustration. This embodiment of a drill floor deck is similar to the drill floor deck that was described with reference to FIGS. 1-8 above. In particular, the embodiment of FIG. 9 comprises a large drill floor deck 107, a dual activity mast 104 and corresponding well centres 123*a,b* arranged side by side, a horizontal pipe storage area 109, a setback structure 112 with vertical pipe handling equipment 113*a,b*, all as described above.

As can easily been seen in FIGS. 9*a-b*, the vertical pipe handling equipment 113*a,b* is movable along the transverse direction along a support beam 130. They may be positioned in longitudinal extension of respective ones of the catwalk machines 108*a,b* between the catwalk machine and the corresponding well centre 123*a,b*, i.e. on the pipe feeding path defined by the corresponding catwalk machine between the catwalk machine and the corresponding well centre. The catwalk machines 108*a,b* are movable on respective rails or skid beams 139*a,b* along the horizontal direction to a respective well centre. Hence, the skid beams define longitudinal pipe feeding paths to the respective well centres.

Also, an iron roughneck 127 is shown positioned between the well centres 123*a,b* and arranged on skid beams, thus allowing the iron roughneck to be moved out of the way, and alternatingly serve both well centres.

Also FIG. 9*a* clearly shows the cylinders 106*a,b* forming a gap 126*a,b*, respectively, so as to allow access to the well centres 123*a,b* directly from the riser storage area 115 by means of a gantry crane 136 and respective slides 132*a,b* leading to the respective well centre.

FIGS. 9*a,b* also show the driller's cabin 134 positioned inside the footprint of the mast 104, transversely between the well centres. Hence, the driller's cabin does not interfere with the access paths 114*a,b* from the open drill floor deck areas 110*a,b*, while allowing convenient visual control with both well centres. The open drill floor deck areas 110*a,b* comprise parts 117*a,b* that extend along the catwalk machines, and a connecting drill floor deck area 118 connecting the lateral open drill floor deck areas 110*a,b* with each other, also all as described above.

Figure 10:
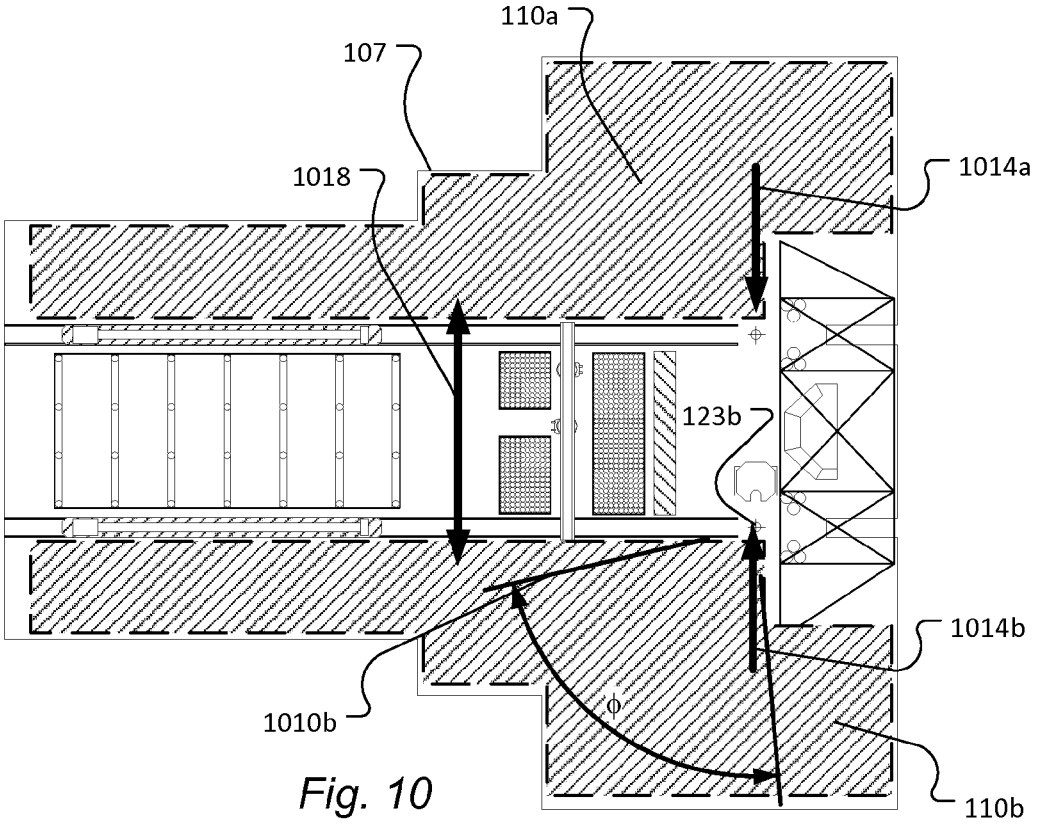
FIG. 10 schematically illustrates the open drill floor deck areas in an embodiment of a drilling rig.

FIG. 10 shows the drill floor deck 107 of FIGS. 9*a,b* clearly illustrating the open drill floor deck areas 110*a,b* as hatched areas. The drill floor deck area extending outside the footprint of the first mast is sized and shaped so as to allow installation of skid beams for skidding equipment and/or for a forklift or other vehicles to operate on the drill floor deck area outside the mast footprint. For example, the drill floor deck area outside the mast footprint may be at least 200 $m^2$, such as at least 500 $m^2$, such as at least 1000 $m^2$, such as at least 2000 $m^2$, e.g. at least 5000 $m^2$. The open drill floor deck areas are not otherwise obstructed by fixed installations such as the first mast, further masts, pipe handling equipment, and/or the like. The open drill floor deck area has a free height of at least 3 m, such as at least 5 m, such as at least 6 m, such as at least 8 m, such as at least 10 m, such as at least 20 m, e.g. at least 30 m. FIG. 10 also illustrates the lateral access from the open drill floor deck areas to the well centres by arrows 1014*a,b*. The access paths 1014*a,b* are straight and they extend entirely outside the footprint of the mast. The additional path connecting the open drill floor deck areas with each other is illustrated by arrow 1018. All access and connecting paths 1014*a,b* and 1018 are wide enough to be equipped with skid beams and/or allowing fork lifts or similar vehicles to operate across the entire drill floor deck. For example, the access and connecting paths may each be at least 2 m wide, such as at least 3 m e.g. at least 5 m wide. FIG. 10 further illustrates the large open drill floor deck sector 1010*b* around the well centre 123*b*. The sector 1010*b* may have a radius of at least 5 m such as 20 m, such as 30 m, the sector having a central angle $\phi$ of at least 60°, such as at least 90°, e.g. at least 120°.

Generally, as illustrated by sector 1010*b*, each well centre defines polar coordinates ($\theta$,$\rho$) on the drill floor deck where the mast position resides at $\theta$=0 and the mast footprint spans from $\theta_{mast,min}$ (negative) to $\theta_{mast,max}$ intersecting at $\rho_{mast,min}$ and $\rho_{mast,max}$ at these angles, respectively. In some embodiments, the open drill floor deck spans more than 1 m, such as more than 2 m, such as more than 5 m, such as more than 10 m, e.g. more than 20 m within an angle interval $\Delta\theta$ spanning from $\theta_{mast,max}$ or below $\theta_{mast,min}$. In some embodiments, $\Delta\theta$ is larger than 10°, such as larger than 30°, such as larger than 60°, such as larger than 90°, e.g. larger than 30°.

Figure 11:
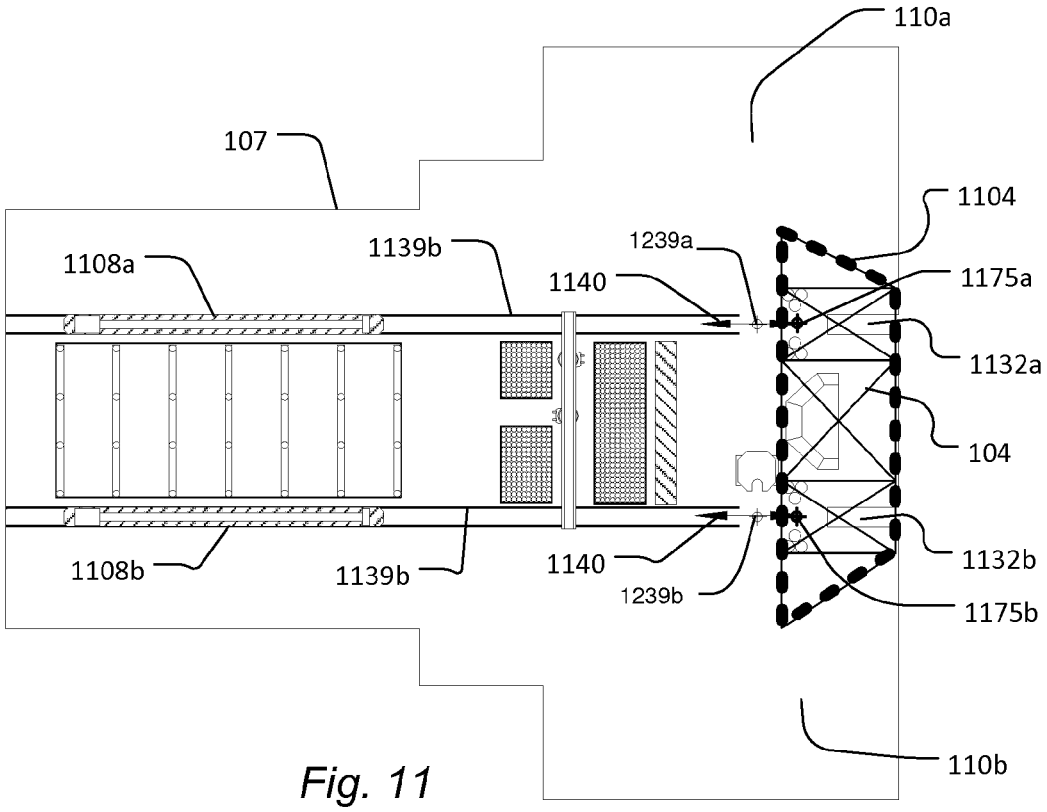
FIG. 11 schematically illustrates the footprint of the mast in an embodiment of a drilling rig.

FIG. 11 shows the drill floor deck 107 of FIGS. 9*a,b* clearly illustrating the footprint of the mast 104 by a dotted line 1104. The well centres 123*a,b* are each located outside the footprint, and they are displaced from the footprint and from the cylinders 106*a,b* along the longitudinal direction 1140. The longitudinal direction 1140 may be defined by the position of the well centres 123*a,b* and the positions 1175*a,b* of the corresponding hoisting systems. The position of the hoisting system may be defined by the centre of mass of the corresponding one of the sheaves 133*a,b* shown e.g. in FIG. 1. FIG. 11 also illustrates the pipe feeding paths along which tubulars are advanced to the respective well centres, namely the pipe feeding paths 1239*a,b* defined by the skid beams of the catwalk machines 1108*a,b*, and the pipe feeding paths 1132*a,b* defined by respective slides for advancing tubulars from a rear side of the hoisting systems. In this embodiment, all pipe feeding paths extend along the longitudinal direction 1140, and they do not cross or otherwise interfere with the open drill floor deck areas 110*a,b*.

Figure 12:
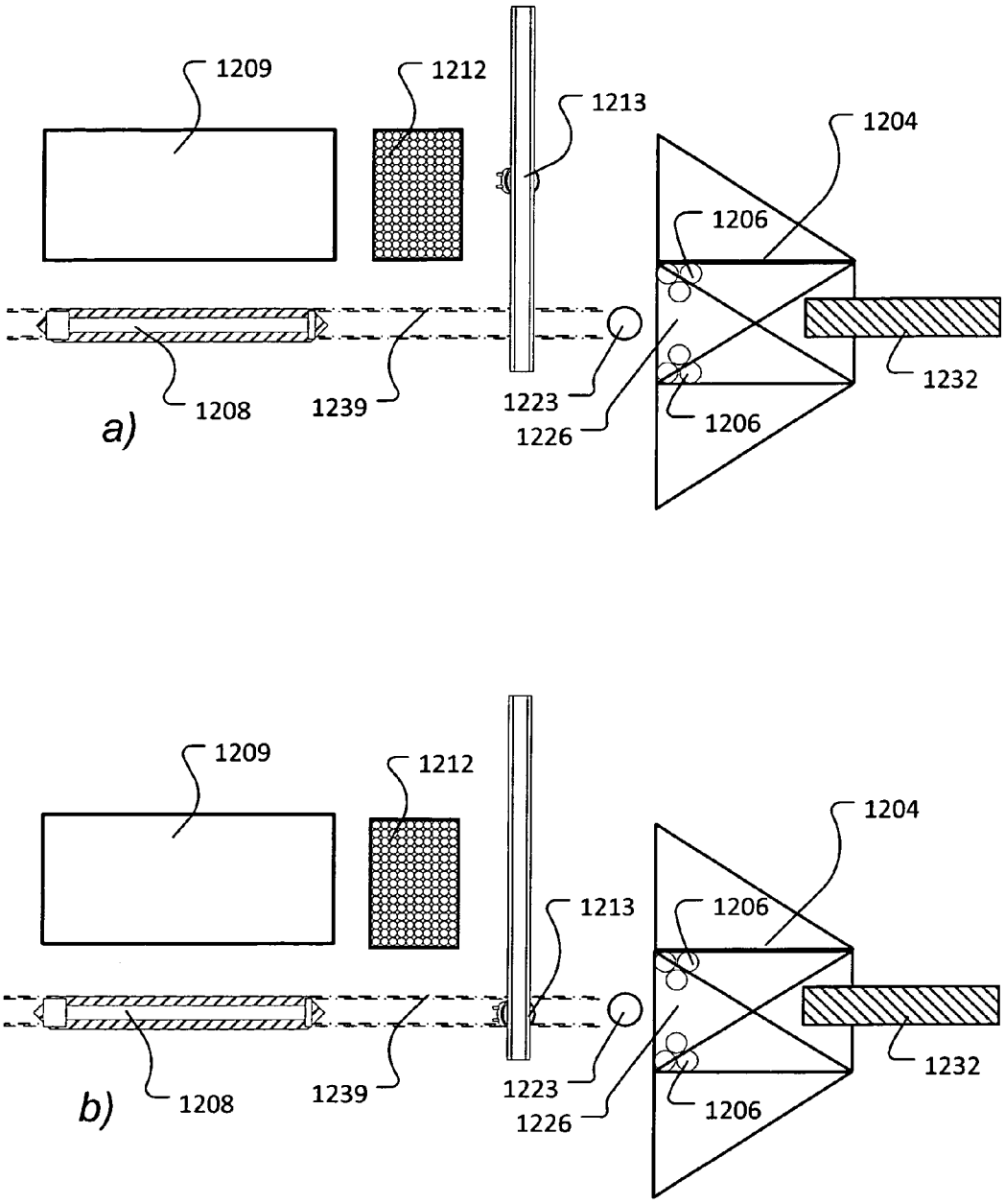
FIGS. 12*a* and *b* schematically illustrates drill floor deck layouts of another embodiment of a drilling rig.

FIG. 12 illustrates a drill floor deck layout with a single well centre 1223, but using the same principles as described in connection with the drilling rig shown in FIGS. 1-8. The drilling deck of FIG. 12 comprises a mast 1204, a well centre 1223, a pipe storage area 1209, a setback structure 1212, horizontal pipe handling equipment 1208 and vertical pipe handling equipment 1213, all as described above. Also in this embodiment, the drilling rig comprises access paths to the well centre from all four sides, i.e. from both longitudinal directions and from both transverse directions.

In FIG. 12*a*, the vertical pipe handling equipment 1213 is positioned away from and, in particular, transversely displaced relative to the pipe feeding path defined by rails or skid beams 1239 between the horizontal pipe handling equipment 1208 and the well centre 1223. Hence, in this position the horizontal pipe handling equipment 1208 may move along skid beams 1239 all the way to the well centre 1223.

FIG. 12*b* shows the vertical pipe handling equipment 1213 in a position on the pipe feeding path 1239 connecting the horizontal pipe handling equipment 1208 and the well centre 1223. Hence, in this configuration, the horizontal pipe handling equipment 1208 may cooperate with the vertical pipe handling equipment 1213.

As in the previous embodiments, the mast comprises a hydraulic hoisting system where the cylinders 1206 are arranged so as to form a central gap 1226, through which risers from a storage area behind the mast may be moved to the well centre 1223 e.g. using a slide 1232 or other pipe handling equipment.

Figure 13:
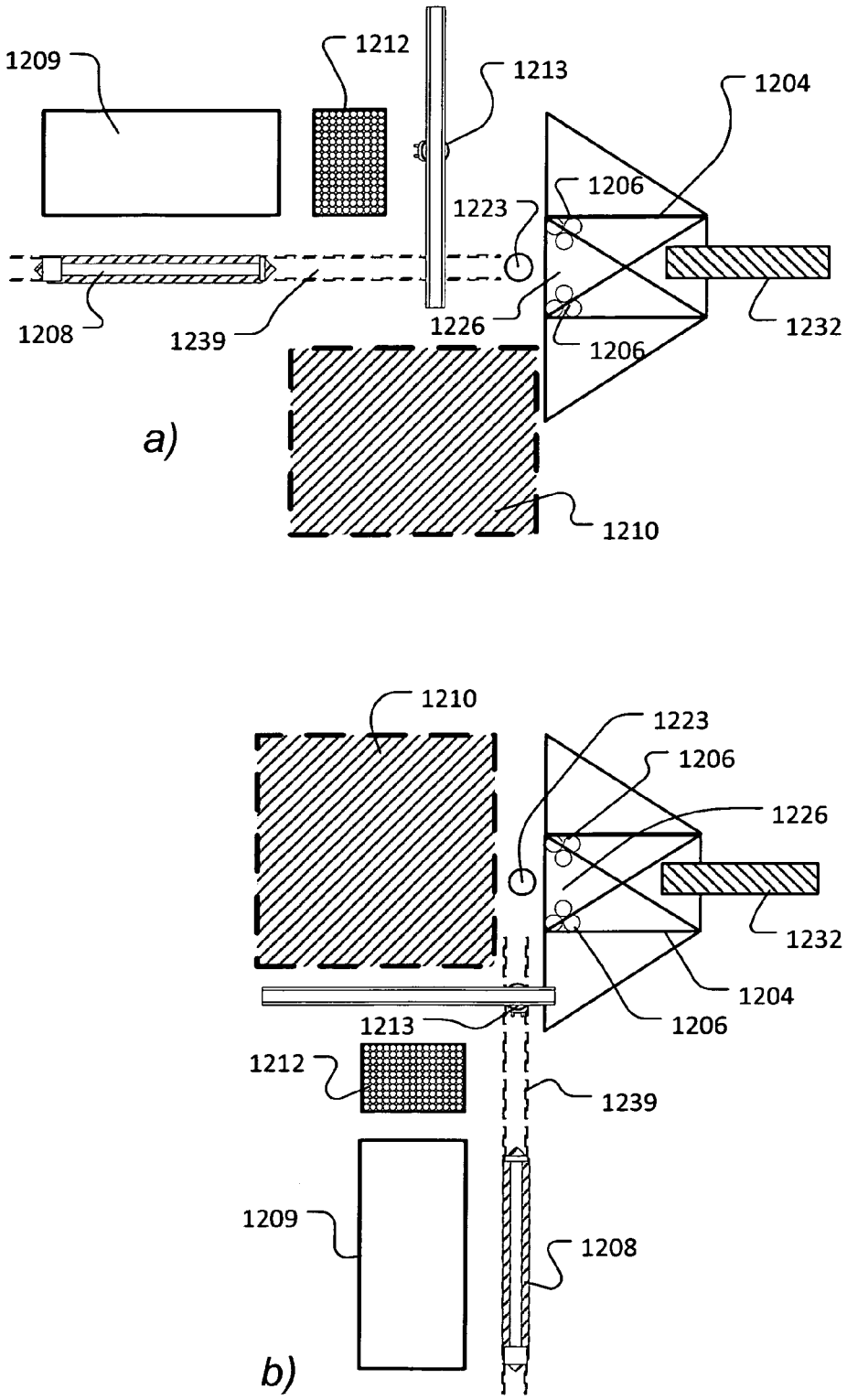
FIGS. 13*a* and *b* schematically illustrates drill floor deck layouts of further embodiments of a drilling rig.

FIG. 13 shows embodiments of a drill floor deck similar to the one of FIG. 12, comprising a mast 1204, a well centre 1223, a pipe storage area 1209, a setback structure 1212, horizontal pipe handling equipment 1208 movable on rails 1239, vertical pipe handling equipment 1213, a hoisting system comprising cylinders 1206 arranged in groups forming a gap between them, and pipe handling equipment 1232 for moving risers or other tubulars through the gap 1226, all as described above.

In particular, in the example of FIG. 13*a*, the pipe storage area 1209, the setback structure 1212, the horizontal pipe handling equipment 1208 and the vertical pipe handling equipment 1213 are located longitudinally aligned with the mast 1204. In the example of FIG. 13*b*, the pipe storage area 1209, the setback structure 1212, the horizontal pipe handling equipment 1208 and the vertical pipe handling equipment 1213 are located transversely displaced from the mast. Hence, in FIG. 13*a* the pipe feeding path 1239 used by pipe handling equipment 1208 extends in the longitudinal direction as in the previous examples, while in the example of FIG. 13*b*, the pipe feeding path 1239 extends in a transverse direction. Nevertheless, in both examples, the drill floor deck comprises an open drill floor deck area 1210 shown schematically as a hatched area. In FIG. 13*a*, the open drill floor deck area is located adjacent the mast in the transverse direction, while the open drill floor deck area of FIG. 13*b* is located adjacent the first mast in the longitudinal direction.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several features, several of these features can be embodied by one and the same item of hardware. The mere fact that certain measures are recited in mutually different dependent claims or described in different embodiments does not indicate that a combination of these measures cannot be used to advantage. For example, even though not explicitly shown, it will be appreciated that the drilling rigs of FIGS. 9-13 may be provided with a guard structure as described herein and/or a hoistable mounting structure as described herein.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An offshore drilling rig comprising a drill floor deck having a hole defining a first well centre;

a first mast upwardly extending relative to the drill floor deck, the first mast defining a first mast footprint on the drill floor deck, wherein the first mast is displaced from and located on a first side of the first well centre such that the first mast footprint is outside the first well centre;

a first hoisting system supported by the first mast and configured for hoisting and lowering tubular equipment through the first well centre; and first pipe handling equipment for moving tubular equipment to the first hoisting system so as to allow the first hoisting system to hoist or lower the tubular equipment through the first well centre;

wherein the drill floor deck comprises:

at least a first open drill floor deck area located adjacent the first mast and outside the first mast footprint; and skid beams installed on the first open drill floor deck area and configured to enable equipment to be skidded across the first open drill floor deck area;

wherein the drill floor deck comprises a rotary table at the first well centre, and the skid beams are substantially level with a portion of the drill floor deck surrounding the hole defining the first well centre.

2. An offshore drilling rig according to claim 1, wherein the offshore drilling rig is a semi-submersible drilling rig.

3. An offshore drilling rig according to claim 1, wherein the first pipe handling equipment defines a first pipe feeding path along which tubular equipment is moved towards the first well centre.

4. An offshore drilling rig according to claim 3, wherein the first pipe feeding path extends substantially along a longitudinal direction defined within a plane of the drill floor deck by the first well centre and the first hoisting system.

5. An offshore drilling rig according to claim 3, wherein the first pipe handling equipment comprises a first horizontal pipe handling equipment extending along the first pipe feeding path; and first vertical pipe handling equipment for handling at least vertically oriented tubular equipment.

6. An offshore drilling rig according to claim 5, wherein the first well centre is positioned on the first pipe feeding path defined by the first horizontal pipe handling equipment; and wherein the first vertical pipe handling equipment is movable between at least a first position on the first pipe feeding path between the first horizontal pipe handling equipment and the first well centre and a second position transversely displaced relative to the first pipe feeding path.

7. An offshore drilling rig according to claim 1, wherein the drill floor deck comprises at least a first open drill floor deck area located adjacent the first mast other than any drill floor deck area configured for movement of tubular equipment or well-control equipment to the first well centre during normal drilling operation; and an access path connecting the open drill floor deck area with the first well centre.

8. An offshore drilling rig according to claim 7, wherein the drilling rig is configured to perform movement of tubular equipment or well-control equipment to the first well centre along one or more pipe feeding paths during normal use which one or more pipe feeding path only crosses drill floor deck areas outside the first open drill floor deck area.

9. An offshore drilling rig according to claim 7, wherein the access path extends entirely outside the footprint of the first mast.

10. An offshore drilling rig according to claim 7, wherein the access path is a straight access path.

11. An offshore drilling rig according to claim 7, wherein the first open drill floor deck area is located adjacent the first mast in a longitudinal direction defined within a plane of the drill floor deck by the first well centre and the first hoisting system.

12. An offshore drilling rig according to claim 7, wherein the first open drill floor deck area is located adjacent the first mast in a transverse direction normal to a longitudinal direction defined within a plane of the drill floor deck by the first well centre and the first hoisting system.

13. An offshore drilling rig according to claim 1, comprising a guard structure configured to prevent tubular equipment operated above the first well centre from falling onto the drill floor deck area in a direction away from the first mast.

14. An offshore drilling rig according to claim 13, wherein the guard structure is elevated above the drill floor deck so as to provide an access path to the first well centre under the guard structure.

15. An offshore drilling rig according to claim 13, wherein the guard structure is configured to be moved between different elevations above the drill floor deck.

16. An offshore drilling rig according to claim 13, wherein the guard structure is operable to be moved between a closed position where it prevents tubular equipment operated above the first well centre from falling onto the drill floor deck area and an open position where it allows unobstructed access to the first well centre.

17. An offshore drilling rig according to claim 13; wherein the guard structure extends between support structures located on respective sides of the first well centre.

18. An offshore drilling rig according to claim 1, comprising a mounting structure for suspending suspendable auxiliary equipment from an elevated position above the drill floor deck, allowing the auxiliary equipment to be lowered or hoisted through the first well centre; wherein the mounting structure is movable between a lower position for rigging up auxiliary equipment to the mounting structure, and an elevated position allowing lowering or hoisting of auxiliary equipment suspended from the mounting structure through the first well centre.

19. An offshore drilling rig according to claim 18, wherein the mounting structure extends between support structures located on respective sides of the first well centre.

20. An offshore drilling rig according to claim 1, wherein the first mast and the first hoisting system are configured to allow tubular equipment to be moved towards the first well centre from the first side.

21. An offshore drilling rig according to claim 20, wherein the first mast and the first hoisting system define an opening through which tubular equipment is movable towards the first well centre from the first side.

22. An offshore drilling rig according to claim 21, wherein the first hoisting system is a hydraulic hoisting system comprising a plurality of cylinders extending upwardly relative to the drill floor deck, wherein the cylinders are arranged as at least two groups of cylinders that are laterally spaced apart from each other so as to form a gap between the two groups of cylinders through which gap tubular equipment is movable towards the first well centre from the first side.

23. An offshore drilling rig according to claim 1, wherein the drilling rig further comprises a pipe storage structure positioned on a second side of the first well centre opposite the first side.

24. An offshore drilling rig according to claim 1, wherein the drilling rig further comprises a second well centre displaced from the first well centre; the positions of the first and second well centres together defining a transverse direction in the plane of the drill floor deck;

a second mast upwardly extending relative to the drill floor deck, and a second hoisting system supported by the second mast and configured for hoisting and lowering tubular equipment through the second well centre; wherein the first and second masts are arranged side by side in the transverse direction.

25. An offshore drilling rig according to claim 24, further comprising second pipe handling equipment, wherein the first pipe handling equipment defines a first pipe feeding path, along which first pipe feeding path tubular equipment is moved towards the first well centre; and wherein the second pipe handling equipment defines a second pipe feeding path, along which tubular equipment is moved towards the second well centre.

26. An offshore drilling rig according to claim 25, wherein the first and second pipe feeding paths extend substantially along a longitudinal direction normal to the transverse direction.

27. An offshore drilling rig according to claim 25, further comprising a pipe storage structure positioned longitudinally displaced from the first and second well centres on a second side of the first well centre opposite the first side and transversely positioned between the first and the second pipe feeding paths.

28. An offshore drilling rig according to claim 25, wherein the drill floor deck comprises at least a first open drill floor deck area located adjacent to one of the first and second masts other than any drill floor deck area configured for movement of tubular equipment or well-control equipment to the first or second well centre during normal drilling operation; and an access path connecting the open drill floor deck area with the first and second well centres.

29. An offshore drilling rig according to claim 28, wherein the first open drill floor deck area is located adjacent the first or second mast in the transverse direction; and wherein the access path is a straight access path extending from the first open drill floor deck area through the first and second well centres.

30. An off-shore drilling rig according to claim 24, comprising respective open drill floor deck areas, one adjacent to each of the first and second masts, other than any drill floor deck area configured for movement of tubular equipment or well-control equipment to the first or second well centre during normal drilling operation; and respective access paths connecting the open drill floor deck areas with the first and second well centres.

31. An offshore drilling rig according to claim 30, wherein each of the open drill floor deck areas comprises an access path extending outside the footprint of the first and second masts and along the transverse direction to the first and second well centres.

32. An offshore drilling rig according to claim 31, wherein the drill floor deck comprises a connecting drill floor deck area connecting the first and second open drill floor deck areas.

33. An offshore drilling rig according to claim 24, configured to allow drilling operations to be performed through each of the first and second well centres.

34. An offshore drilling rig according to claim 1, wherein at least a part of the drill floor deck is formed by a roof of an enclosure for accommodating mud mixing equipment and/or other operational equipment of the drilling rig.

35. An offshore drilling rig according to claim 1, wherein the skid beams are adjacent the first well centre.

36. An offshore drilling rig according to claim 1, wherein the skid beams are mounted such that there is an absence of height difference between the skid beams and the drill floor deck to enable human operators and movable equipment to move along-side the tubular equipment.

37. An offshore drilling rig according to claim 36, wherein the skid beams are mounted flush with the drill floor deck.

38. An offshore drilling rig according to claim 1, wherein an area of the drill floor deck outside the mast footprint is at least 200 $m^2$.

39. An offshore drilling rig according to claim 1, wherein an area of the drill floor deck outside the mast footprint is at least 1000 $m^2$.

40. An offshore drilling rig according to claim 1, wherein an area of the drill floor deck outside the mast footprint is at least 5000 $m^2$.

* * * * *